US006085124A

United States Patent [19]

Choi

[11] Patent Number: 6,085,124

[45] Date of Patent: Jul. 4, 2000

[54] AUTOMATIC PARKING SYSTEM

[75] Inventor: Dong Jin Choi, Kyoungsangnam-Do, Rep. of Korea

[73] Assignee: LG Industrial Systems Co, Ltd., Seoul, Rep. of Korea

[21] Appl. No.: 09/134,353

[22] Filed: Aug. 14, 1998

[30] Foreign Application Priority Data

Aug. 16, 1997 [KR] Rep. of Korea ..... P97-39033

[51] Int. Cl.[7] ..... E04H 6/22

[52] U.S. Cl. ..... 700/217; 700/214; 700/218; 700/215; 414/234; 414/252; 705/13

[58] Field of Search ..... 700/217, 214, 700/218, 215; 414/231, 232, 234, 252; 705/13, 404

[56] References Cited

U.S. PATENT DOCUMENTS

| | | | |
|---|---|---|---|
| 4,166,546 | 9/1979 | English | 414/263 |
| 5,018,926 | 5/1991 | Sternad | 414/253 |
| 5,024,571 | 6/1991 | Shahar et al. | 414/231 |
| 5,267,822 | 12/1993 | Paravia et al. | 414/239 |
| 5,469,676 | 11/1995 | Colsman | 52/174 |
| 5,669,753 | 9/1997 | Schween | 414/786 |
| 5,678,972 | 10/1997 | Bockler et al. | 414/239 |
| 5,933,354 | 8/1999 | Shimada et al. | 364/479.16 |
| 5,940,481 | 8/1999 | Zeitman | 379/114 |
| 6,006,148 | 12/1999 | Strong | 701/33 |

FOREIGN PATENT DOCUMENTS

| | | | |
|---|---|---|---|
| 3819710A1 | 12/1989 | Germany | E04H 6/22 |
| 19733907A1 | 2/1999 | Germany | E04H 6/12 |
| 2260536A | 4/1993 | United Kingdom | E04H 6/18 |
| WO 90/07043 | 6/1992 | WIPO | E04H 6/22 |

*Primary Examiner*—Christopher P. Ellis
*Assistant Examiner*—Michael E. Butler

[57] ABSTRACT

The present invention provides an automatic parking system in which the computer, the parking ticket issuer, and the parking ticket recognizer are connected in a network such that each unit exchanges information as it needs, and then the system controlling processes of loading and unloading a car, issuing the parking ticket, recognizing the parking ticket, and calculating the fee for ensuring accuracy of the calculation and convenience of the usage. The parking system includes a keyboard, a mouse, a database for storing vehicle number data, which are input from the keyboard, and loading information data, which are received in loading a car, in each respective data field, a display for displaying the information data, a data processor connected to the parking installation controller for processing car loading/unloading information data, a loading/unloading control processor for controlling operation of the parking installation controller, a calculating processor for calculating and displaying a parking fee, a parking ticket issuer for issuing the parking ticket, and a parking ticket recognizer for scanning the parking ticket in unloading operation.

9 Claims, 19 Drawing Sheets

FIG. 12

PARKING TICKET

○ ○ MECHANICAL PARKING INSTALLATION

BASIC FEE : ADDITIONAL FEE :

SERIAL NUMBER BAR CODE

97 / 06 / 09 PALLET NUMBER

11 : 35 : 25 LOADED POSITION

THANK YOU... VEHICLE NUMBER

○ ○ PARKING LOT.

AUTOMATIC PARKING SYSTEM

BACKGROUND OF THE INVENTION

1. Field of the Invention

The present invention relates to a technique of controlling a mechanical parking system and calculating a parking fee, and more particularly to a parking control system to which a computer, a control unit, a parking ticket issuer, and a parking ticket recognizer are connected via a network for allowing any required information to be used among them.

2. Description of the Prior Art

Generally in a conventional mechanical parking system, a car is moved to a respective floor along hoistway with use of a lift, then parked in respective parking space with use of pallets. In that system, a fee calculator and a parking ticket issuer are separately operated such that each operation of a parking machine, a parking ticket issuer, and the fee calculator is performed separately.

For example, as shown in FIG. 1, the conventional mechanical parking installation includes a lift 102 for lifting a car 101 to a respective floor by a user, a lift driving device 103 for carrying the lift in upper and lower directions within hoistway, a plurality of pallets 105 which load a car 101, carried to a respective floor by the lift 102, to a parking space 104 or which unload a car 101, already loaded to the parking space, toward the lift 102, a manipulating unit 106 for manipulating the car 101 to be loaded and unloaded, and a control unit 107 for detecting a status of loading and unloading the car and a manipulating condition and for controlling that manipulation of loading and unloading the car. The operation of the installation will be explained below, referred to FIGS. 2 and 3.

At first, the process for manipulating the car to be loaded in the parking space will be explained.

When a user loads a car 101 on the lift 102 of the parking installation, a central process unit 304, hereinafter referred to CPU, finds out a position of the car based on detect signals of various sensors, which is input via an input unit 301, and then outputs guidance information through an output unit 302.

Accordingly, the user designates a vehicle number and a loading position in a car-loading mode after confirming its safety with use of a ten key 206 of the manipulating unit 106.

At this time, CPU 204 of the manipulating unit 106 outputs a control command designated by the ten key 206, and the command is transmitted via a communication unit 205 and a communication line 208 (RS485 or RS422) to the control unit 107.

Following that, the control unit 107 monitors a position of the car 101 through the input unit 301 and, at the same time, controls the lift driving device 103 such that the lift 102 can moves to a respective floor. Then the control unit 107 controls the pallet 105 to be moved laterally such that the car 101 can be loaded in a respective parking space 104.

After completion of the above loading process, a driver receives a parking ticket written by hand or issued by a parking ticket issuer.

From now on, the process of manipulating the car 101 to be unloaded will be explained.

In unloading the car, the user reads contents of the parking ticket and calculates its fee by hand or by calculator. Then, after confirming its safety with the manipulating unit 106, the user notifies an unloading command by such a manner of designating the vehicle number or the loaded position.

At this time, the control unit 107 unloads the car 101 in a process reverse to the loading process, according to the unloading command notified from the manipulating unit 106.

However, in such a conventional parking installation, because the driving unit, the fee calculator, and the ticket issuer are operated separately and therefore the user performs a driving operation and a ticket issuing operation separately, there are difficulties for the user to manipulate the system, and furthermore, there are some defects in accuracy of calculating the fee.

SUMMARY OF THE INVENTION

Accordingly, an object of the present invention is to provide an automatic parking system in which the computer, the parking ticket issuer, and the parking ticket recognizer are connected in a network such that each unit exchanges information as it needs, and then the system controlling processes of loading and unloading a car, issuing the parking ticket, recognizing the parking ticket, and calculating the fee for ensuring accuracy of the calculation and convenience of the usage.

In order to achieve the above and other advantages, an object of the present invention is to provide an automatic parking system comprising a parking apparatus having pallets used for loading a plurality of cars, a first motor for moving the pallets laterally, a first motor drive for providing a driving signal to the motor, a first sensor for sensing the presence of the car on the pallets, a first encoding means for detecting a position of the pallets by calculating a number of revolutions of the motor, at least one lift which is able to move vertically for loading the car on the pallets and unloading the car out of the pallets, a second sensor for sensing the presence of the car on the lift, a third sensor for sensing the presence of the lift on a respective floor, a second motor for moving the lift vertically, a second motor drive for driving the second motor, a second encoding means for detecting a position of the lift by calculating a number of revolutions of the second motor; and a parking controller connected to the first and second motor drives for outputting position control signals to each of them, for receiving feedbacks of a pallet position detect signal and a lift position detect signal from the first and second encoding means, for determining a present operating status of the parking apparatus on the basis of the position control signal, the position detect signal, and a sensing signal from the first and second sensors, for storing an identifier of each pallet and a vehicle number of a car loaded on the respective pallet, for receiving information of the presence or absence of a car on each pallet from the first sensor and for storing the information, further comprising; a keyboard; a mouse for supporting a user to select a specific region on a screen by clicking thereon; database means for storing each vehicle number which is input with use of the keyboard by user, current date and time data which are received on loading the car, data which have the pallet identifier and information data about whether the car is parked on the respective pallet, data about a parking fee, data about a configuration of a loading screen, data about a configuration of an unloading screen, and data about a configuration of a calculation screen, in corresponding data fields; means for displaying information data on the screen; data processing means connected to the displaying means for selectively outputting loading data, unloading data, and calculation data, which are received from the database means, outputting a parking apparatus status signal, a signal of sensing the presence of the car on each pallet received from the parking controller to be displayed on a corresponding region of the loading screen or the unloading screen displayed by the displaying means, for receiving a signal of sensing the presence of the car on the lift from the controller when the car is loaded on the lift, for creating loading time data containing current date and time data by a timer equipped therein when the user inputs the vehicle number with use of the keyboard, for creating loading serial number data updated for each time of loading, then outputting the loading serial number data to the database means together with the vehicle number data, and for creating and outputting a loading/unloading command signal; processing means for controlling car loading/unloading, for receiving a command loading/unloading signal and a vehicle number data signal of the car to be loaded or unloaded from the data processing means, in case of loading for receiving the loading command signal and the vehicle number data signal from the data processing means, determining a pallet having priority among the empty pallets depending on the presence data of the car on the pallets stored in the database means, for outputting an identifier signal of the pallet determined by the controller, and at the same time, outputting the identifier signal of the pallet determined and the vehicle number data signal on the displaying means for displaying on the loading screen, in case of unloading for receiving the unloading command signal and the vehicle number data signal from the data processing means and outputting the vehicle number data signal together with the unloading command signal to the controller; means for processing calculation for receiving current date and time data, the loading time data, and the fee data from the data processing means, calculating a parking fee to be requested to a customer on the basis of an elapsed time from the loading time and the fee data, then creating and outputting a debit data signal according to the result of the calculation, for receiving a fee payment data of the customer from the data processing means, creating and outputting a credit data signal, for calculating difference between the credit data signal and the debit data signal, and then creating and outputting the result as a balance data signal; a parking ticket issuer for issuing the parking ticket on the basis of the loading serial number data, the loading date and time data, the vehicle number data, and the identifier data of the pallet used for loading, received from the data processing means; and a parking ticket recognizer for scanning the parking ticket and outputting the loading serial number data to the data processing means.

Another object of the present invention is to provide an automatic parking system comprising a parking apparatus having pallets used for loading a plurality of cars, a first motor for moving the pallets laterally, a first motor drive for providing a driving signal to the motor, a first sensor for sensing the presence of the car on the pallets, a first encoding means for detecting a position of the pallets by calculating a number of revolutions of the motor, at least one lift which is able to move vertically for loading the car on the pallets and unloading the car out of the pallets, a second sensor for sensing the presence of the car on the lift, a third sensor for sensing the presence of the lift on a respective floor, a second motor for moving the lift vertically, a second motor drive for driving the second motor, a second encoding means for detecting a position of the lift by calculating a number of revolutions of the second motor; a parking controller connected to the first and second motor drives for outputting position control signals to each of them, for receiving feedbacks of a pallet position detect signal and a lift position detect signal from the first and second encoding means, -for determining present operation status of the parking apparatus on the basis of the position control signal, the position detect signal, and a sensing signal from the first and second sensors, for storing an identifier of each pallet and a vehicle number of a car loaded on the respective pallet, for receiving information of the presence or absence of a car on each pallet from the first sensor and for storing the information; and a manipulating unit having an input button unit having a plurality of number and character keys and a plurality of function keys, for selectively inputting the vehicle number and the pallet identifier or canceling the input information, inputting information to perform function of searching a loading position or of unloading a car out of a parking place, and inputting information for resetting the function, by pushing the buttons; a first displaying means for displaying the presence of the car on each pallet; a second displaying means for selectively displaying the vehicle number information which is input by the input button unit, the identifier information of the pallet on which the car is loaded, and a present operation status information of the parking apparatus; and a microprocessor for processing and storing the data input by the input button unit according to a predetermined program, and at the same time, outputting the data to the first and second displaying means so to be displayed, for transmitting the vehicle number information or the pallet identifier information to the controller, for outputting the car presence data on the pallet and the current operating status data of the parking apparatus to the first and second displaying means respectively so to be displayed thereon, the automatic parking system further comprising; a keyboard; a mouse for supporting a user to select a specific region on a screen by clicking thereon; database means for storing each vehicle number which is input with use of the keyboard by user, current date and time data which is received on loading the car, data which have the pallet identifier and information data about whether the car is parked on the respective pallet, data about a parking fee, data about a configuration of a loading screen, data about a configuration of an unloading screen, and data about a configuration of a calculation screen, in respective data fields; means for displaying information data on the screen; data processing means connected to the displaying means for selectively outputting loading data, unloading data, and calculation data received from the database means to the displaying means, outputting a parking apparatus status signal, a signal of sensing the presence of the car on each pallet received from the parking controller to be displayed on a corresponding region of the loading screen or the unloading screen displayed by the displaying means, for receiving a signal of sensing the presence of the car on the lift from the controller when the car is loaded on the lift, for creating loading time data containing current date and time data by a timer equipped therein when the user inputs the vehicle number with use of the keyboard, for creating loading serial number data updated for each time of loading, then outputting the loading serial number data on the database means together with the vehicle number data, and for creating and outputting a loading/unloading command signal; processing means for controlling car loading/unloading, for receiving a loading/unloading command signal and a vehicle number data signal of the car to be loading/unloading from the data processing means, in case of loading for receiving the loading command signal and the vehicle number data signal from the data processing means, determining a pallet having priority among the empty pallets depending on the presence data of the car on the pallets stored in the database means, for outputting an identifier signal of the pallet determined by the controller, and at the same time, outputting the identifier signal of the pallet determined and the vehicle number data on the displaying means for displaying on the loading screen, in case of unloading for receiving the unloading command signal and the vehicle number data signal from the data processing means and outputting the vehicle number data signal together with the unloading command signal to the controller; means for processing calculation for receiving current date and time data, the loading time data, and the fee data from the data processing means, calculating a parking fee to be requested to a customer on the basis of an elapsed time from the loading time and the fee data, then creating and outputting a debit data signal according to the result of the calculation, for receiving a fee payment data of the customer from the data processing means, creating and outputting a credit data signal, for calculating difference between the credit data and the debit data, and then creating and outputting the result as a balance data signal; a parking ticket issuer for issuing a parking ticket on the basis of the loading serial number data, the loading date and time data, the vehicle number data, and the identifier data of the pallet used for loading, received from the data processing means; and a parking ticket recognizer for scanning the parking ticket and outputting the loading serial number data to the data processing means.

Still another object of the present invention is to provide an automatic parking system comprising; a parking apparatus having a plurality of loading/unloading means for loading/unloading cars, a driving means for driving the loading/unloading means, and a control means for controlling the driving means; a keyboard; a mouse for supporting a user to select a specific region on a screen by clicking thereon; database means for storing each vehicle number which is input with use of the keyboard by user, current date and time data which are received on loading the car, data which have the pallet identifier and information about whether the car is parked on the respective pallet, data about a parking fee, data about a configuration of a loading screen, data about a configuration of an unloading screen, and data about a configuration of a calculation screen, in corresponding data fields; means for displaying information data on the screen; data processing means connected to the displaying means for selectively outputting loading data, unloading data, and calculation data, which are received from the database means, outputting a parking apparatus status signal, a signal of sensing the presence of the car on each pallet received from the parking controller to be displayed on a corresponding region of the loading screen or the unloading screen displayed by the displaying means, for receiving a signal of sensing the presence of the car on the lift from the controller when the car is loaded on the lift, for creating loading time data containing current date and time data by a timer equipped therein when the user inputs the vehicle number with use of the keyboard, for creating loading serial number data updated for each time of loading, then outputting the loading serial number data to the database means together with the vehicle number data, and for creating and outputting a loading/unloading command signal; processing means for controlling car loading/unloading, for receiving a command loading/unloading signal and a vehicle number data signal of the car to be loaded or unloaded from the data processing means, in case of loading for receiving the loading command signal and the vehicle number data signal from the data processing means, determining a pallet having priority among the empty pallets depending on the presence data of the car on the pallets stored in the database means, for outputting an identifier signal of the pallet determined by the controller, and at the same time, outputting the identifier signal of the pallet determined and the vehicle number data to the displaying means for displaying on the loading screen, in case of unloading for receiving the unloading command signal and the vehicle number data signal from the data processing means, outputting the vehicle number data signal together with the unloading command signal to the controller; means for processing calculation for receiving current date and time data, the loading time data, and the fee data from the data processing means, calculating a parking fee to be requested to a customer on the basis of an elapsed time from the loading time and the fee data, then creating and outputting a debit data signal according to the result of the calculation, for receiving a fee payment data of the customer from the data processing means, creating and outputting a credit data signal, for calculating difference between the credit data signal and the debit data signal, and then creating and outputting the result as a balance data signal.

BRIEF DESCRIPTION OF THE DRAWINGS

The above and other advantages of the present invention will be clearly understood by describing in detail the preferred embodiment thereof with reference to the attached drawings, in which

FIG. 12 shows an example of a parking ticket.

DETAILED DESCRIPTION OF THE INVENTION

Hereinafter, an embodiment of the automatic parking system according to the present invention will be described in detail with reference to the attached drawings.

Figure 1:
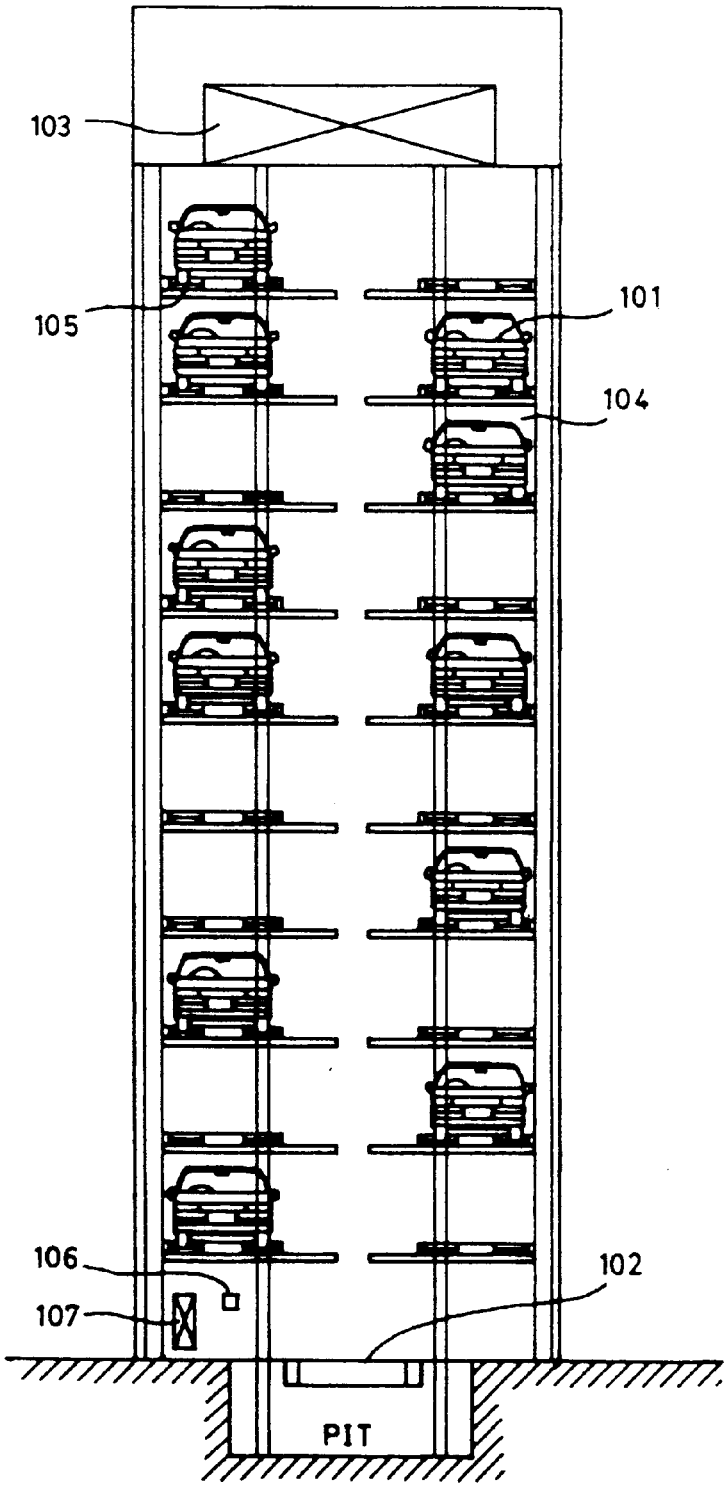
FIG. 1 PRIOR ART
FIG. 1 is a cross sectional view showing a mechanical parking installation according to the conventional art.
Figure 2:
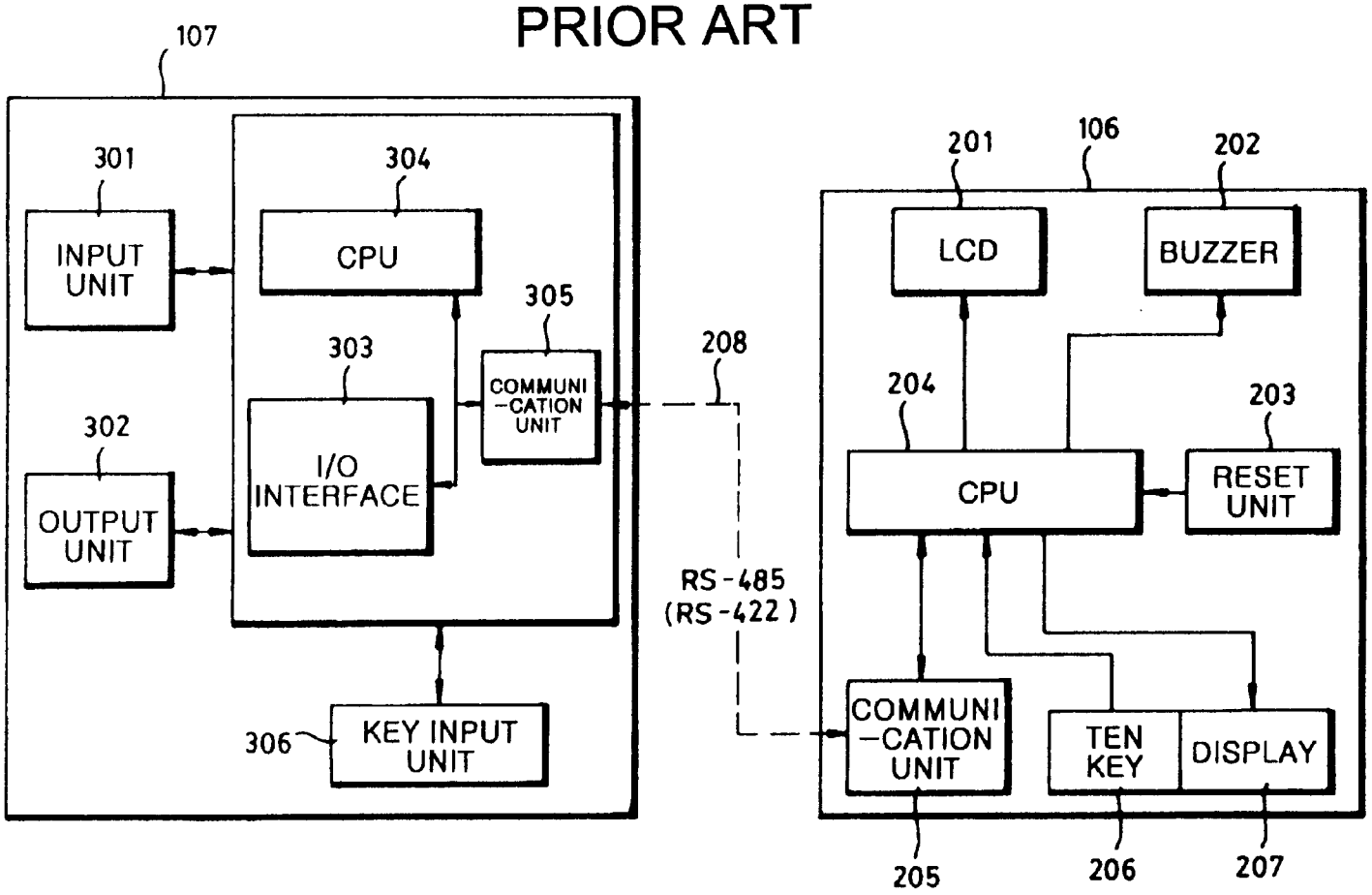
FIG. 2 PRIOR ART
FIG. 2 is a block diagram showing a control apparatus of the mechanical parking installation according to the conventional art.
Figure 3A:
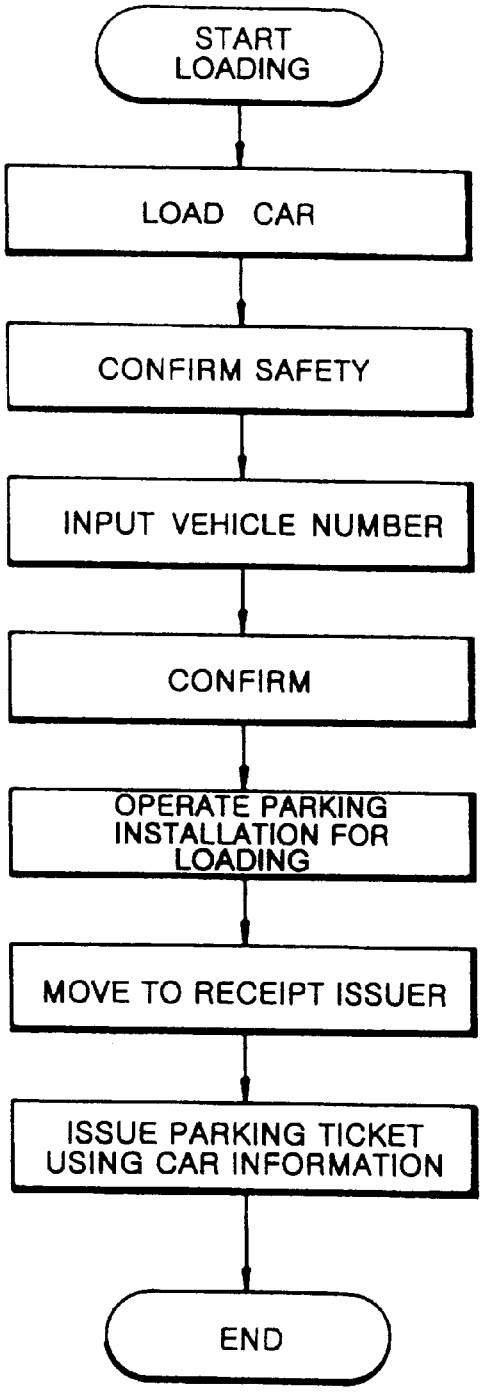
FIG. 3A PRIOR ART
FIGS. 3*a* and 3*b* are flow charts showing the processes of loading and unloading a car, implemented in the control apparatus of the mechanical parking installation according to the conventional art.
Figure 3B:
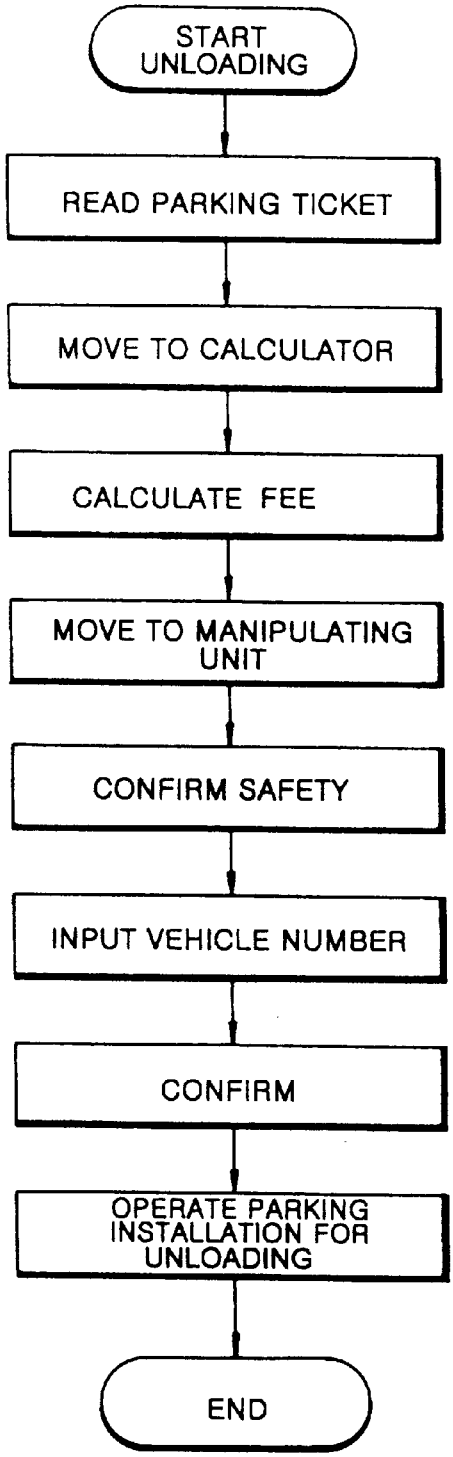
FIG. 3B PRIOR ART
Figure 4:
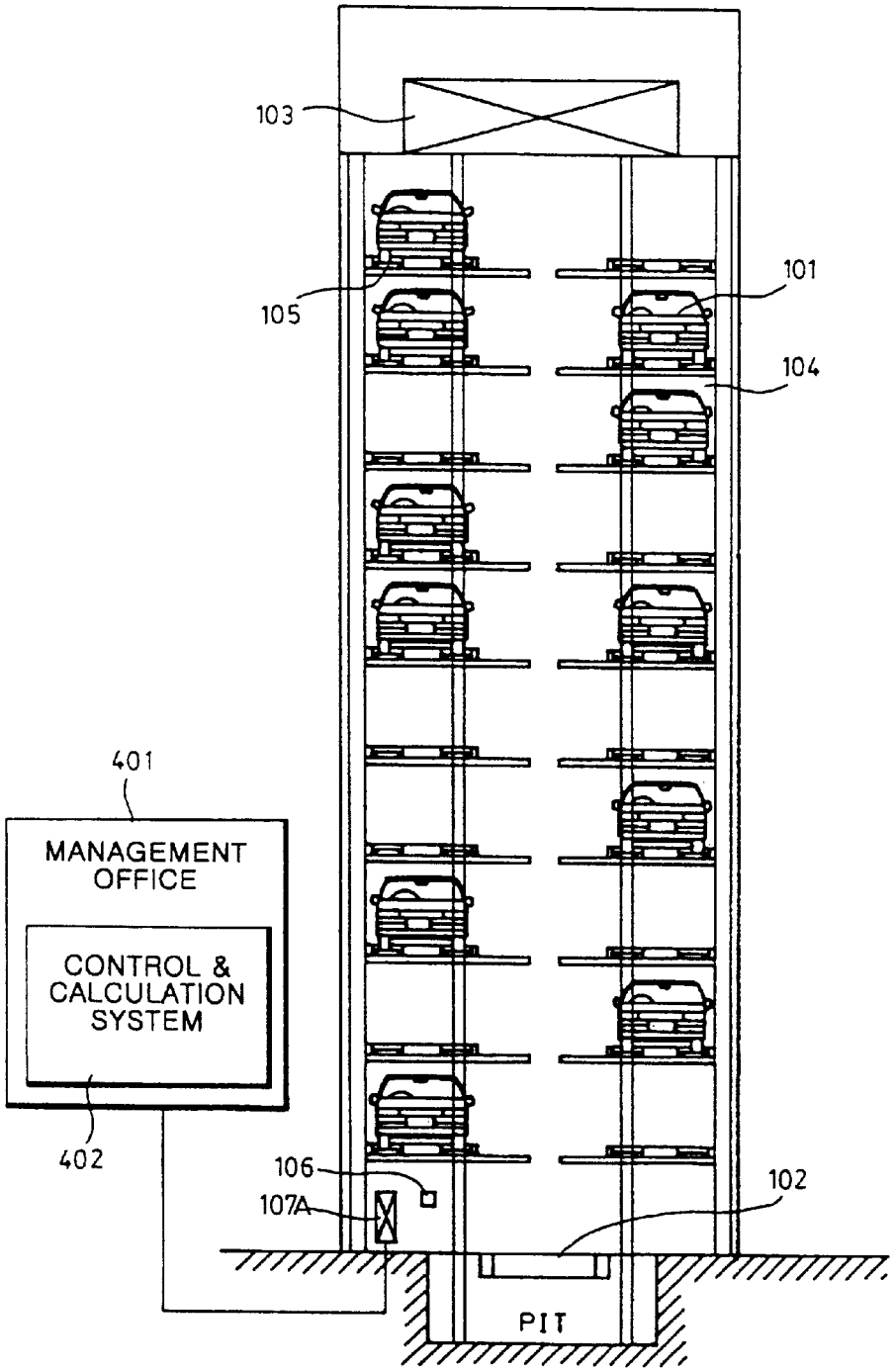
FIG. 4 is a schematic view showing an automatic parking system according to the present invention.

FIG. 4 is a cross sectional view of a parking installation according to the present invention. The parking installation preferably comprises a plurality of pallets 105 used for loading a car, a first motor (not shown in figures) for moving the pallets laterally, a first motor drive (not shown in figures) for driving the first motor, a first sensor (not shown in figures) for sensing the presence of the car on the pallets, a first encoder (not shown in figures) for detecting a position of the pallets by calculating a number of revolutions of the first motor, at least one lift 102 which is able to move vertically for loading the car on the pallets or unloading the car out of the pallet, a second sensor (not shown in figures) for sensing the presence of the car on the lift, a third sensor (not shown in figures) for sensing the presence of the lift on a lobby floor, a second motor for moving the lift vertically, a second motor drive (not shown in figures) for driving the second motor, and a second encoder for detecting a position of the lift by calculating a number of revolutions of the second motor.

Figure 5:
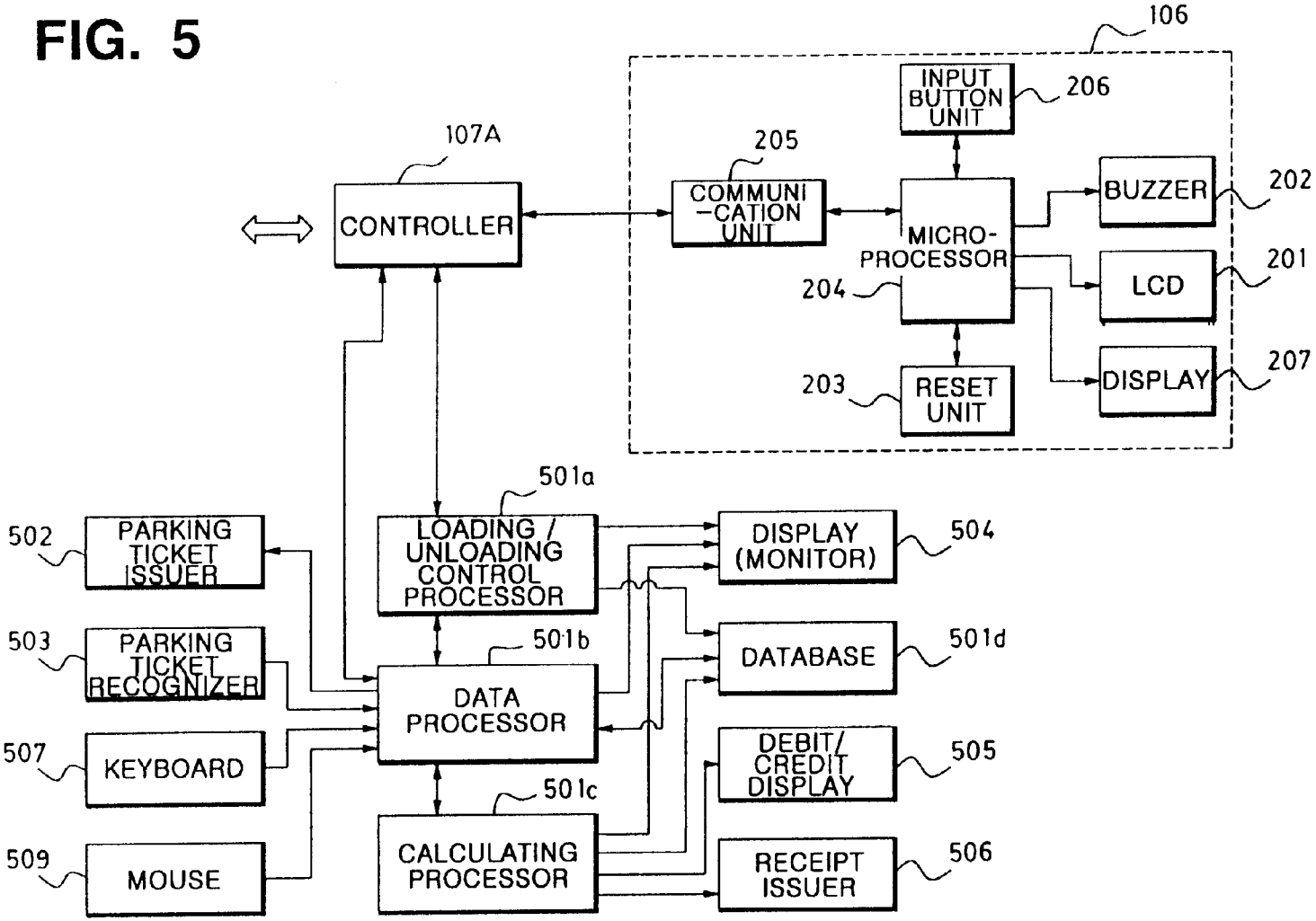
FIG. 5 is a block diagram of an embodiment showing entire construction of a parking system according to the present invention.

FIG. 5 is a block diagram showing entire configuration of the parking system according to the present invention. Referring to the FIG. 5, the parking control system includes a controller 107A which is connected to the first and second motor drives and outputs position control signals to each of them, which receives feedbacks of a pallet position detect signal and a lift position detect signal from the first and second encoder, which determines a present operating status of the parking installation on the basis of the position control signal, the position detect signal, and a sensing signal from the first and second sensors, which stores an identifier of each pallet and a vehicle number of a car loaded on the respective pallet, and which receives information of the presence or absence of a car on each pallet from the first sensor and stores the information.

Additionally, the control system comprises a manipulating unit 106 including an input button unit 206 having a plurality of number and character keys and a plurality of function keys (a safe confirming button, a canceling button, a loading button, an unloading button, a search button, a confirmation button, and so on), for selectively inputting the vehicle number and the pallet identifier or canceling the input information, inputting information to perform function of searching a loaded position or of unloading a car out of a parking place, and inputting information for resetting the function, by pushing the buttons; a first display 207 for displaying the presence of the car on each pallet, which is made of a plurality of seven segment type light emitting diode LED; a second display 201, which can be a liquid crystal display LCD, for selectively displaying the vehicle number information which is input by the input button unit, the identifier information of the pallet on which the car is loaded, and a present operation status information of the parking installation; and a microprocessor 204 which processes and stores the data input by the input button unit according to a predetermined program, and at the same time, outputs the data to the first and second display so to be displayed, which transmits the vehicle number information or the identifier information to the controller, which outputs the car presence data on the pallet and the current operating status data to the first and second display respectively so to be displayed thereon. Besides, the manipulating unit includes a buzzer 202 for making alarming sounds and a reset unit 203 for resetting entire units of the manipulating unit to their initial status when there is an operation error or dangerous situation such as car doors opened status in the parking installation.

The parking control system also includes a keyboard 507; a mouse 509 for supporting a user to select a specific region on a screen by clicking thereon; a display 504 for displaying information data on the screen; a database 501*d* for storing each vehicle number which is input with use of the keyboard by a user, current date and time data which are received on loading the car, parking position information data (pallet identifier), data having information about whether the car is present on the respective parking place (pallet), data about a parking fee (including basic parking fee and additional parking fee per 10 minutes), data about a configuration of a loading screen, data about a configuration of an unloading screen, and data about a configuration of a calculation screen, in respective data fields; data processor 501*b* for selectively outputting loading data, unloading data, and calculation data, which are received from the database, to the display, for generating loading time data containing current date and time by a timer equipped therein when the user inputs the vehicle number with use of the keyboard, for generating loading serial number data updated at each time of car loading, then outputting the loading serial number data on the database with the vehicle number data, for generating and outputting a loading/unloading command signal; processor 501*a* for controlling car loading/unloading, which receives a loading/unloading command signal and a vehicle number data signal of the car to be loaded or unloaded from the data processor, which, in case of loading, when receiving the loading command signal and the vehicle number data signal from the data processor, determines a pallet having priority among the empty pallets after reading the presence data of the car on the pallets recorded in the database, which outputs an identifier signal of the pallet determined by the controller, and at the same time, outputs the identifier signal of the loading place and the vehicle number data to the display, so to be displayed on the loading screen, and which, in case of unloading, when receiving the unloading command signal and the vehicle number data signal from the data processor, outputs the vehicle number data signal together with the unloading command signal to the controller; calculation processor 501*c* for processing calculation which, when receiving current date and time data, the loading time data, and the fee data from the data processor, calculates a parking fee to be requested to a customer on the basis of an elapsed time from the loading time and the fee data, then generating and outputting a debit data signal according to the result of the calculation, which, when receiving a fee payment data of the customer from the data processor, generates and outputs a credit data signal, and which calculates difference between the credit data signal and the debit data signal, and then generates and outputs the result as a balance data signal. At this time, the control unit 107A and the processor 501*a*, 501*b*, 501*c* for controlling loading/unloading, processing data, and processing calculation can be composed of ROMs storing driving programs for each element, a CPU for executing the program, and input/output ports for transmitting signals. Particularly, the RAM in the control unit 107A stores the identifier data for each pallet, the current car presence data according to the identifier data, the vehicle number data of the car loaded, and an altitude value data of the lift so as to correspond to each other.

And, the parking control system further includes a parking ticket issuer 502 for issuing the parking ticket on the basis of the loading serial number data, the loading date and time data, the vehicle number data, and the identifier data of the pallet used for loading, received from the data processor; and a parking ticket recognizer 503 for scanning the parking ticket and outputting the loading serial number data to the data processor.

The parking control system further includes, besides of the display 504, a debit/credit display 505 which receives the debit data signal, the credit data signal, and the balance data signal from the calculation processor, and then displays the signals on each corresponding row of three LCD rows. The debit/credit display 505 is connected to the calculation processor 501*c* via transmission line, and displays a debit which is an amount to be paid by a customer, a credit which is an amount already paid by the customer, and a balance which is a change, such that the customer can confirm each amount. The debit/credit display can be composed by preparing a seven-segment type LCD, having a normal 10 digit structure, in three rows, i.e., upper, medium, and lower rows. Therefore, the display in the upper row displays the parking fee to be paid, the debit, the display in the medium row displays the paid parking fee, the credit, and the display in the lower row displays the change, namely the balance.

The parking control system further includes a receipt issuer 506 for receiving the debit data signal, the credit data signal, and the balance data signal from the calculation processor, and then issuing the data on a receipt. Also, the parking control system includes an uninterruptible power supply UPS 508 for continuously supplying power to the parking control system in commercial power failure.

Figure 6:
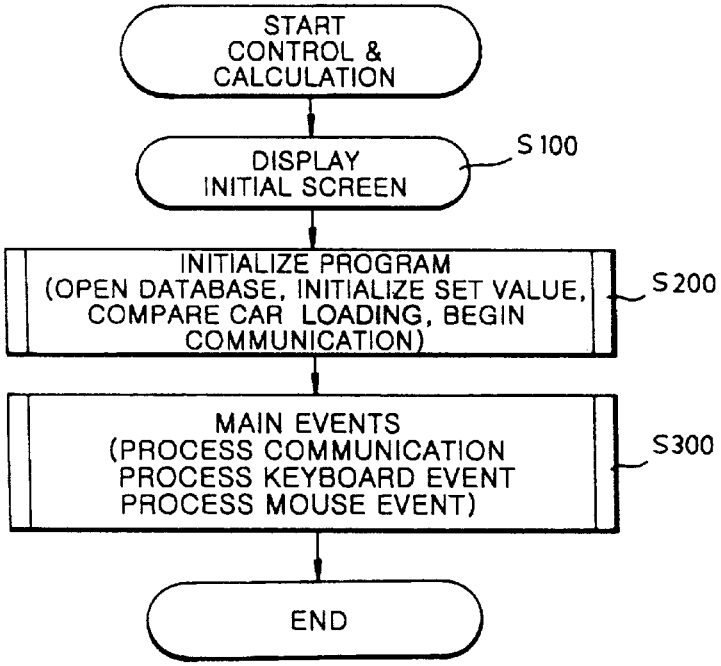
FIG. 6 is a flow chart schematically showing the entire implementing process of the parking system according to the present invention.

FIG. 6 is a flow chart schematically showing the entire processes of the parking control system according to the present invention. Referring to the figure, the process for controlling the system is composed of a start screen displaying step S100 of displaying an initial screen for informing the beginning of the program as soon as power is supplied to the computer, a program initializing step S200 for opening the database, initializing a system set value, comparing the cars loaded in the parking installation, and beginning communication, and a main event processing step S300 for processing main events such as a communication processing, a keyboard event processing, and a mouse event processing.

Figure 7:
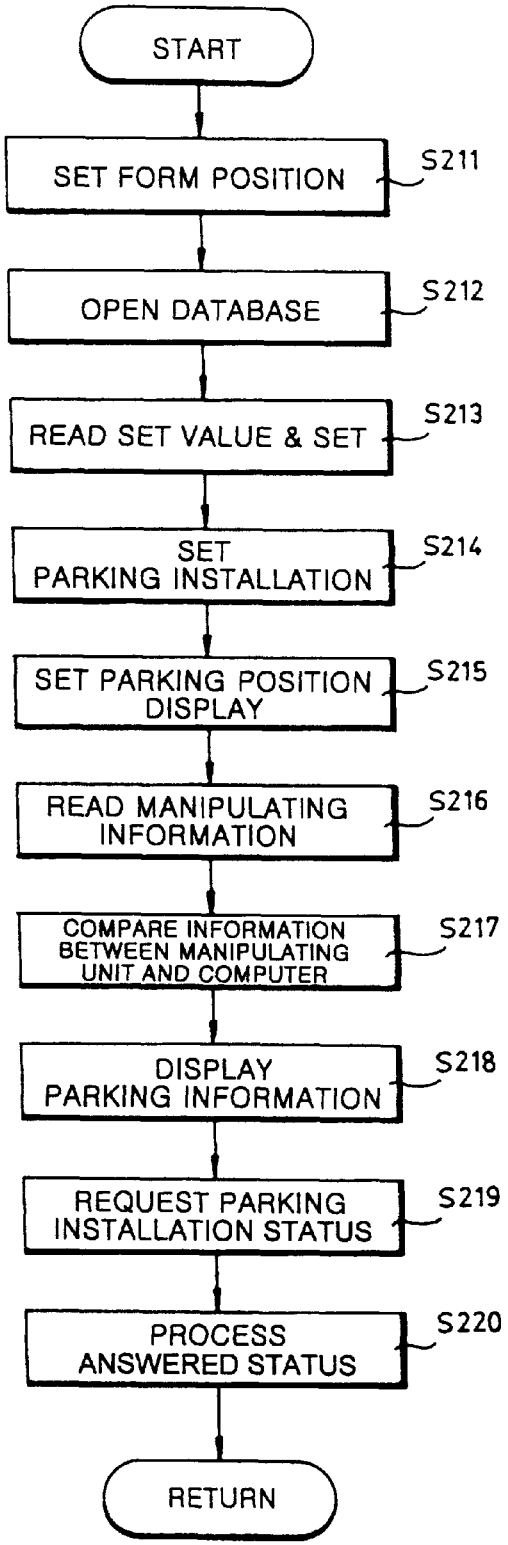
FIG. 7 is a flow chart for explaining an initializing process of the parking system of FIG. 6.

FIG. 7 is a flow chart for explaining the initial process of the parking control system of FIG. 6. As shown in the figures, the initial process is composed of a form position setting step S211 for reading data about arrangement and configure of display regions of the screens from the database, a database opening step S212 for reading and updating display values of each region of the screen from the database, a set value reading and setting step S213 for setting optional data such as a kind of the parking installation, a basic parking fee, an additional parking fee per 10 minute, a name of the parking lot, a greetings, forms of the parking ticket and the receipt, a font style, and so on by a user, a parking equipment setting step S214 for setting types of a communication network connecting to the parking controller, a parking position display setting step S215 for displaying the vehicle number data on a parking installation display region on the screen, a controller information reading step S216 for reading the identifier of each pallet in the parking installation, the car presence data corresponding to each identifier, and the vehicle number which are stored in the controller, a controller and computer information comparing step S217 for comparing data read from the controller with data read from the database, a parking information displaying step S218 for displaying determined data on the displaying region of the screen after determining by giving priority of credibility of the data of the controller when there is difference in result of the comparing step, a parking installation status information requesting step S219 for requesting information about operation status of the parking installation to be transmitted from the controller, and a status response processing step S220 for displaying the parking installation status information on the parking installation status region of the screen.

Figure 8:
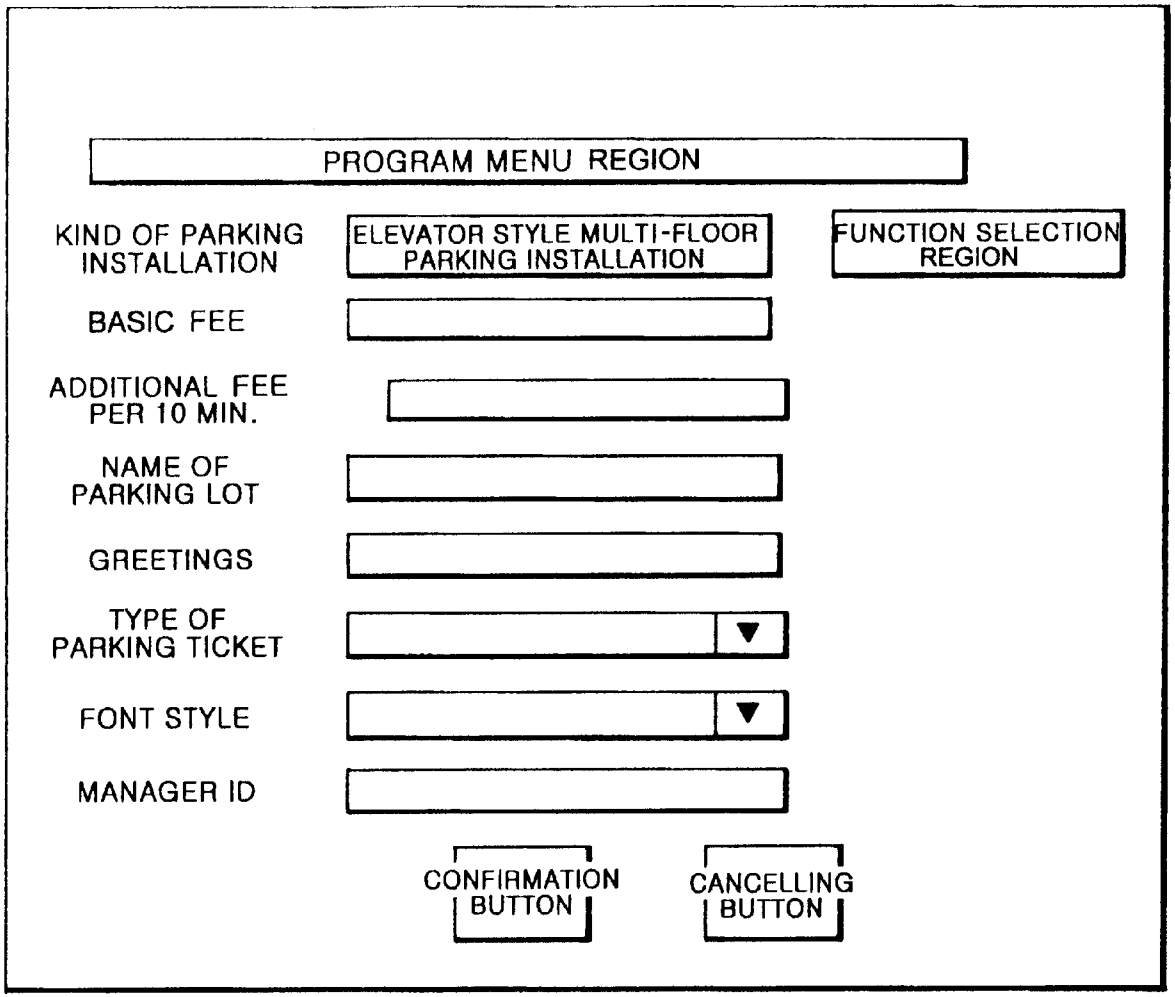
FIG. 8 shows an example of displaying an initial value setting screen according to the steps of selecting and writing initial values in FIG. 7.

FIG. 8 shows an embodiment of the initial value setting screen according to the set value reading and setting step of the FIG. 7. On the setting screen, the optional data such as the kind of the parking installation, the basic parking fee, the additional parking fee per 10 minute, the name of the parking lot, the greeting, the forms of the parking ticket and the receipt, the font type, and so on can be set by the user.

Figure 9C:
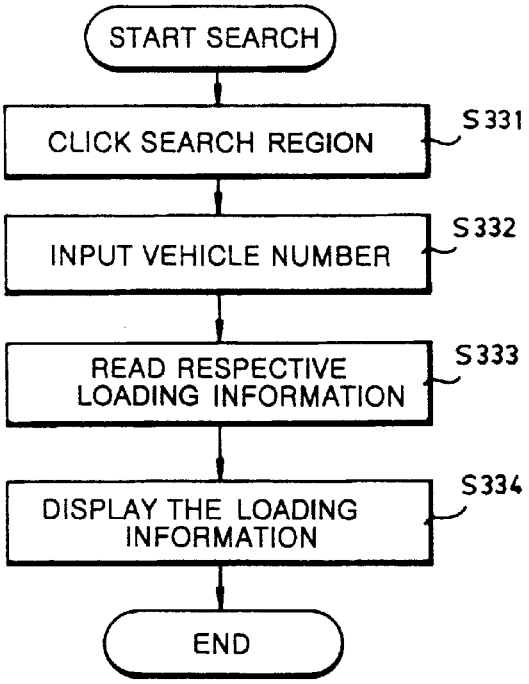
FIGS. 9*a* to 9*c* are flow charts for explaining a loading process and an unloading process respectively, implemented in the parking system according to the present invention.
Figure 9A:
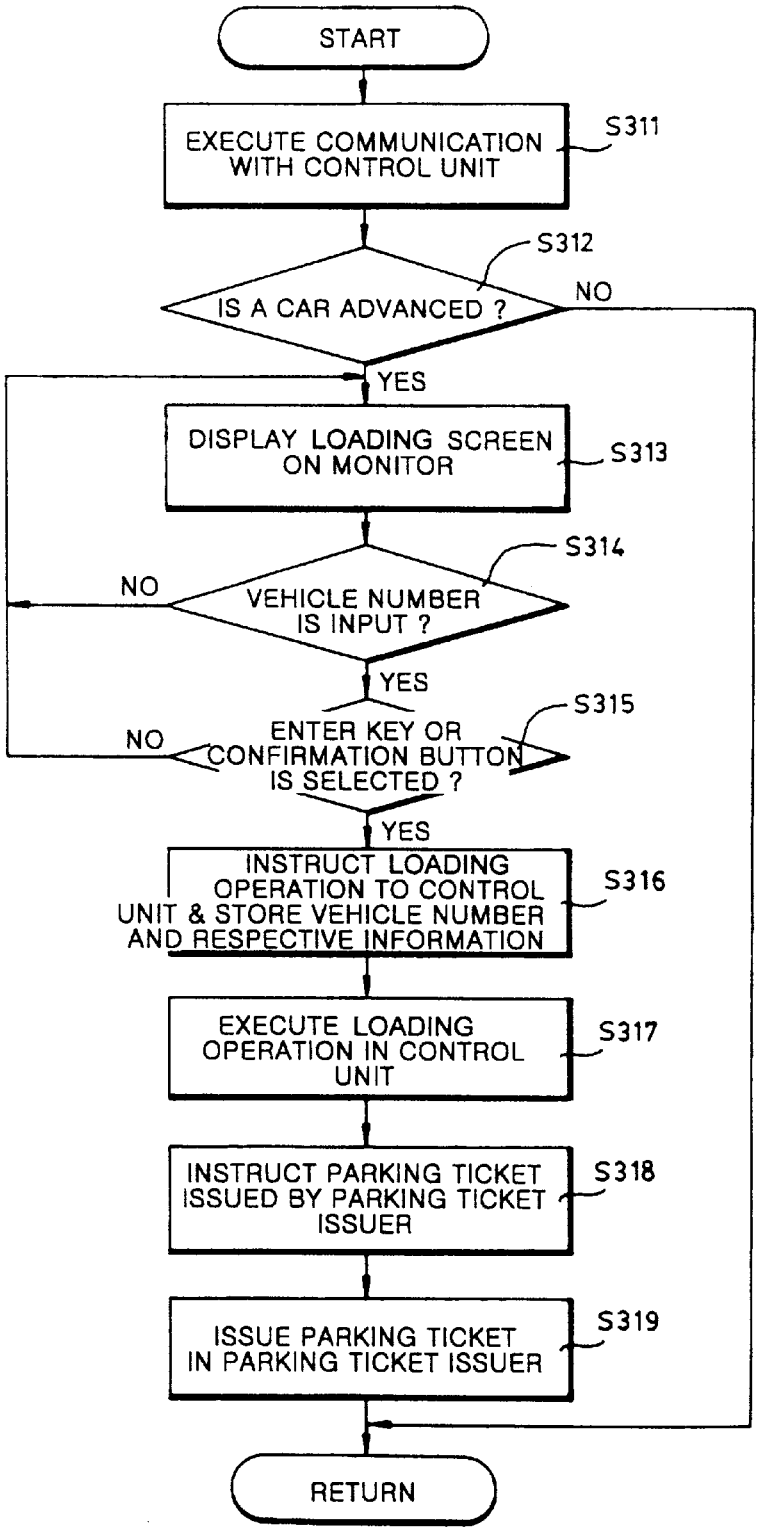

FIG. 9*a* is a flow chart for explaining the loading process implemented by the parking control system of the present invention. In the figure, the loading process is composed of steps S311–S313 of displaying the loading screen on a monitor when a car is advanced therein a decision according to results by communicating with the controller, steps S314–S316 of recognizing events of inputting the vehicle number on the vehicle number inputting region of the loading screen displayed in the monitor with inputting an enter key or clicking on the confirmation button, and then instructing the car to be loaded on the parking installation to the controller and storing information of the car, a step S317 of executing a loading operation in the controller according to the instruction of loading the car, a step S318 of instructing to issue the parking ticket of a predetermined form while executing the loading operation, wherein the parking position, the serial number, the vehicle number, the loading date, the loading time, a kind of the customer, the parking information, and the like are printed on the parking ticket, and a step S319 of issuing the parking ticket according the instruction of issuing the parking ticket.

Figure 9B:
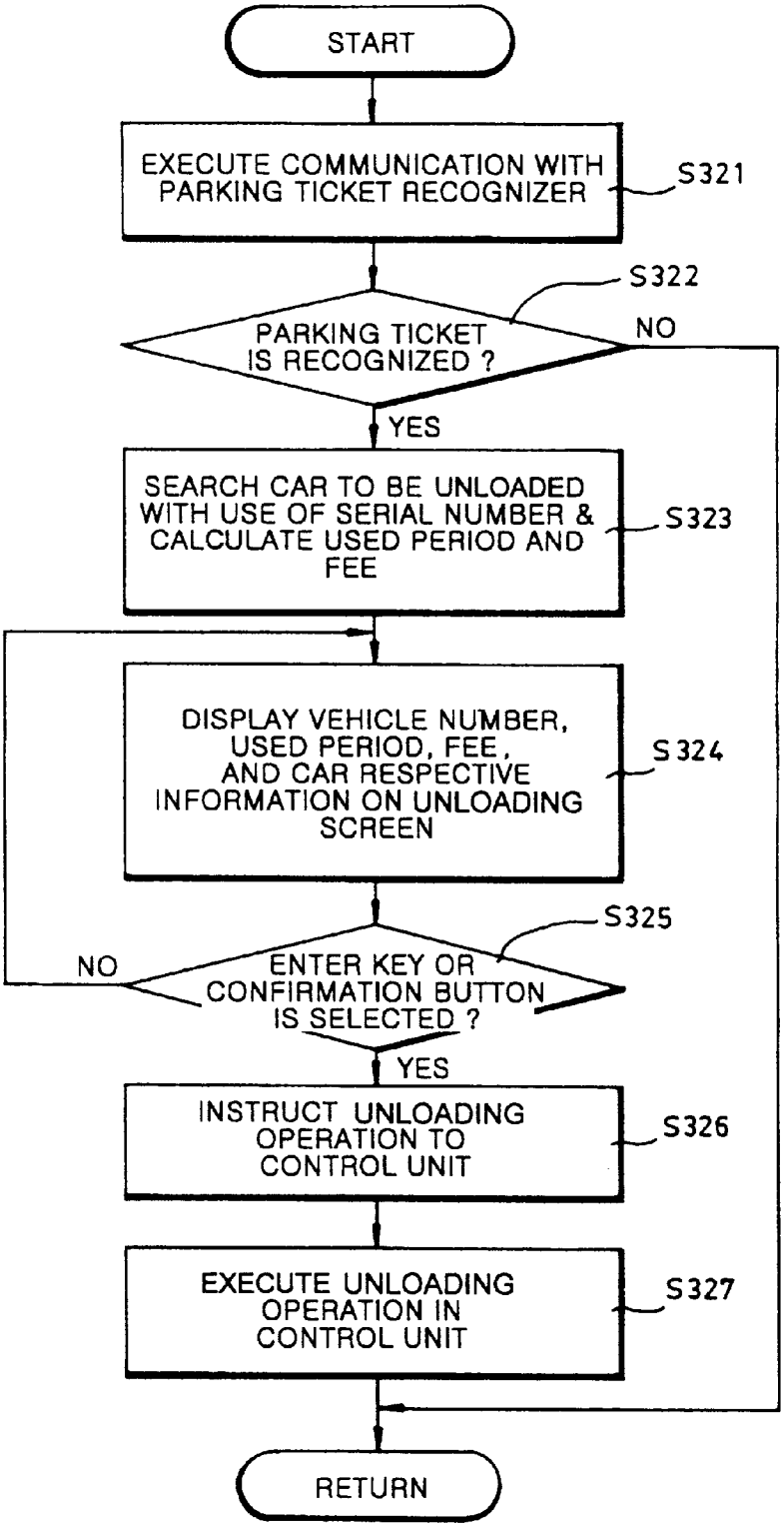

FIG. 9*b* is a flow chart for explaining the unloading process implemented in the parking control system of the present invention. As shown in the figures, the unloading process is composed of steps S321, S322 of recognizing the parking ticket as a result of communication with the parking ticket recognizer and reading its content written thereon, steps S323, S324 of searching a car to be unloaded on the basis of the serial number of the recognized information in the parking ticket, calculating a parked period, beginning to calculate its fee, and then displaying the calculated fee, the vehicle number, the loading/unloading time, the parked period, the kind of the customer, the parking position, and the like on the loading screen, steps S325, S326 of recognizing events of inputting the enter key or clicking on the confirmation button by the user and then instructing the car to be unloaded to the controller of the parking installation, and a step S327 of executing the unloading operation in the controller according to the unloading operating instruction.

FIG. 9*c* is a flow chart for explaining the search process implemented in the parking control system of the present invention. Referring to the figure, the search process is composed of a step S331 of clicking on a search region on the screen with the mouse, a step S332 of inputting the vehicle number of a required car or the parking related information of the respective car with use of the keyboard, a step S333 for searching the loading information of the respective car from the database, and a step S334 of displaying the loading information searched from the database with use of the display.

Figure 10A:
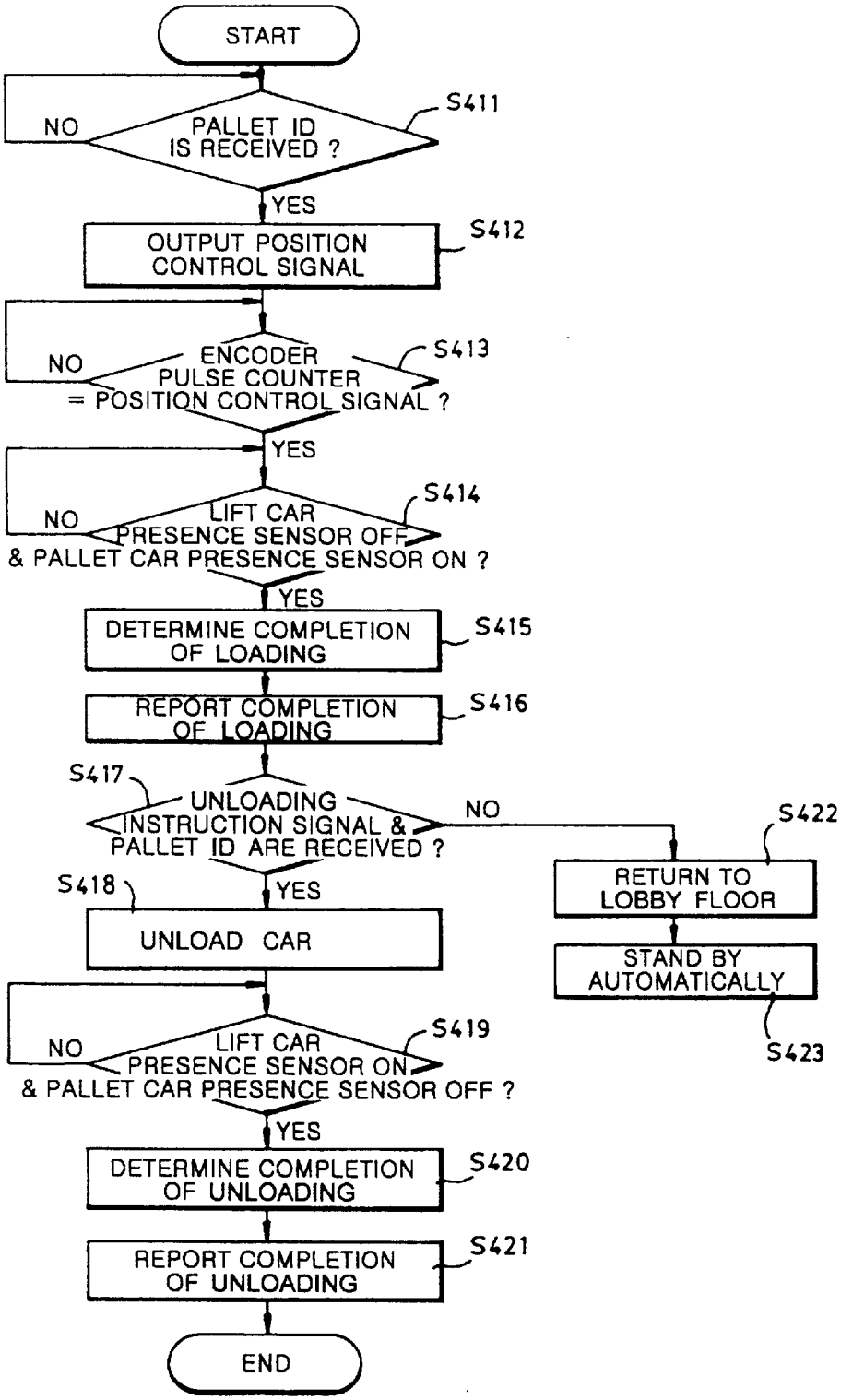
FIGS. 10*a* to 10*b* are flow charts for explaining a loading operation and an unloading operation, implemented in a control unit.

FIG. 10*a* is a flow chart for explaining the process implemented in the parking controller. As shown in the figure, the loading process is composed of a step S411 of receiving the loading operation command signal and the identifier of the pallet on which a car will be loaded, a step S412 of transmitting a position control signal, stored beforehand corresponding to the identifier of the pallet, to the motor drive, steps S413, S414 of operating the lift driving motor with use of the position control signal and standing by until the loading operation is completed, steps S415, S416 of determining the completion of the loading operation when sensing the completion of the loading operation by a result of checking of sensors, and then reporting that to the processor, a step S417 of determining whether or not the unloading command signal and the identifier of the pallet used for unloading the car are received, steps S422, S423 of returning the pallet to the lobby floor for automatically standing by until next command in case that the unloading instruction signal is not received, steps S418, S419 of standing by until completion of the unloading operation with operating the lift driving motor with use of the position control signal in case that the unloading instruction signal is received, and steps S420, S421 of determining completion of the unloading operation when sensing the completion of the unloading operation by a result of checking of the sensors, and then reporting that to the processor.

Figure 10B:
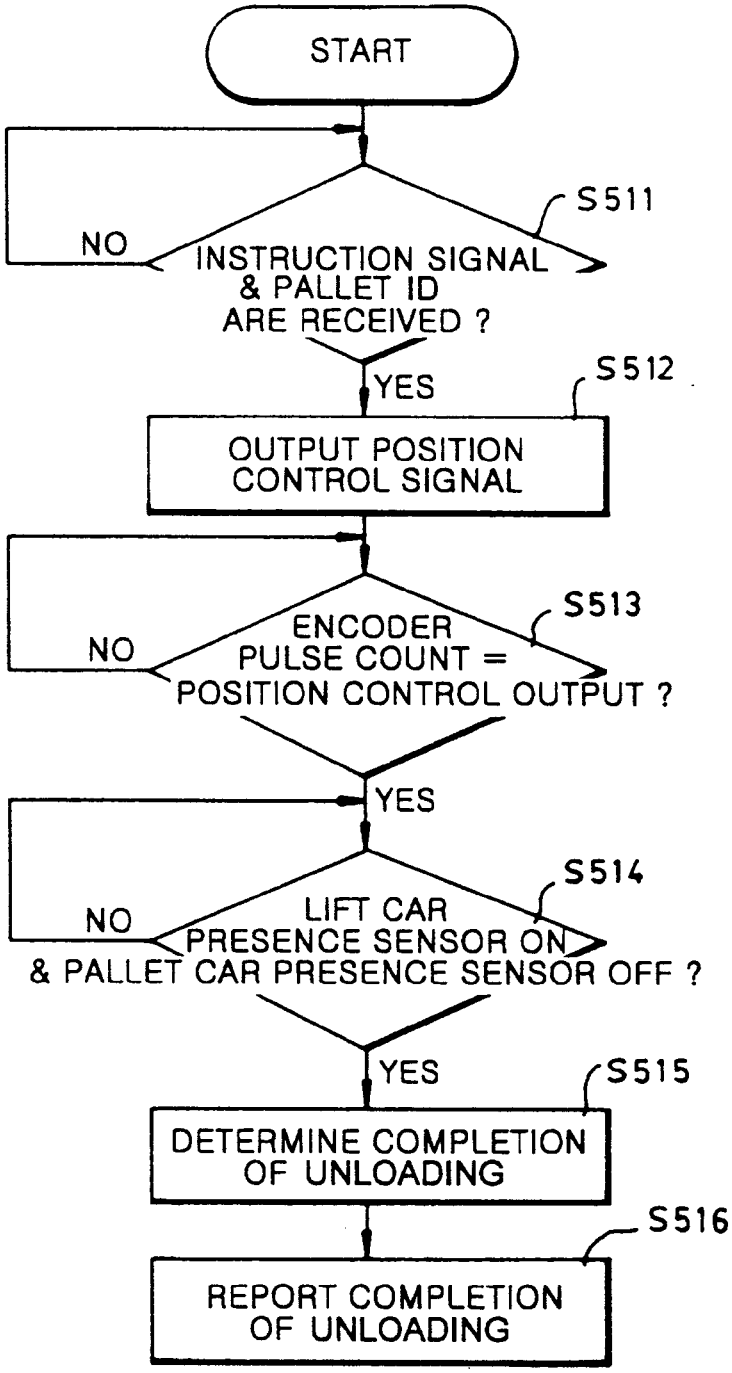

FIG. 10*b* is a flow chart for explaining the unloading process implemented in the parking controller. Referring to the figure, the unloading process is composed of a step S511 of receiving the unloading command signal and the identifier of the pallet subjected to the unloading operation, a step S512 of transmitting the position control signal, stored beforehand corresponding to the identifier of the pallet, to the motor drive, steps S513, S514 of standing by until completion of the unloading operation with operating the lift driving motor with the use of the position control signal, and steps S515, S516 of determining completion of the unloading operation when sensing the completion of the unloading operation by a result of checking of the sensors, and then reporting that to the processor.

Figure 11A:
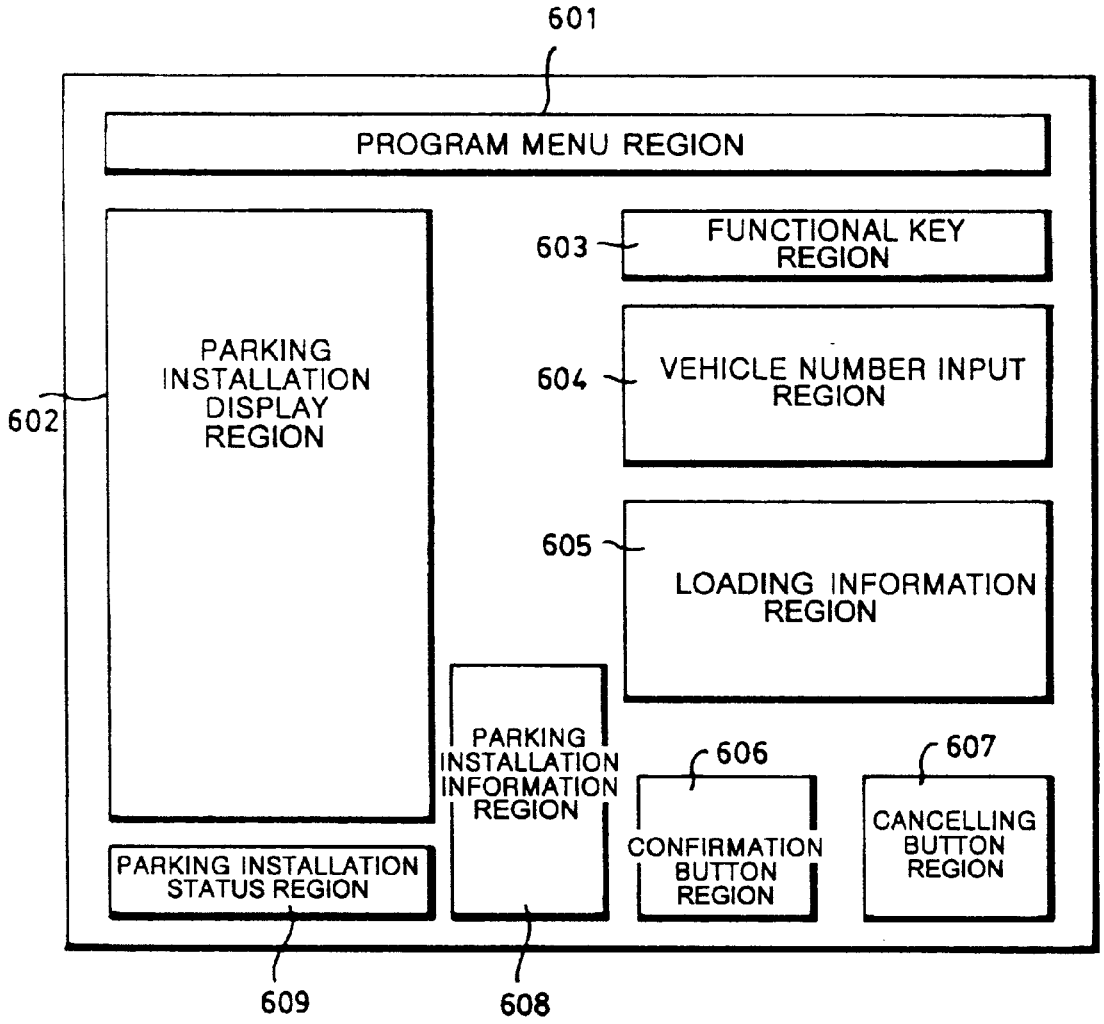
FIGS. 11*a* to 11*e* show examples of a loading screen, an unloading screen, a search screen, and a calculating screen respectively.
Figure 11B:
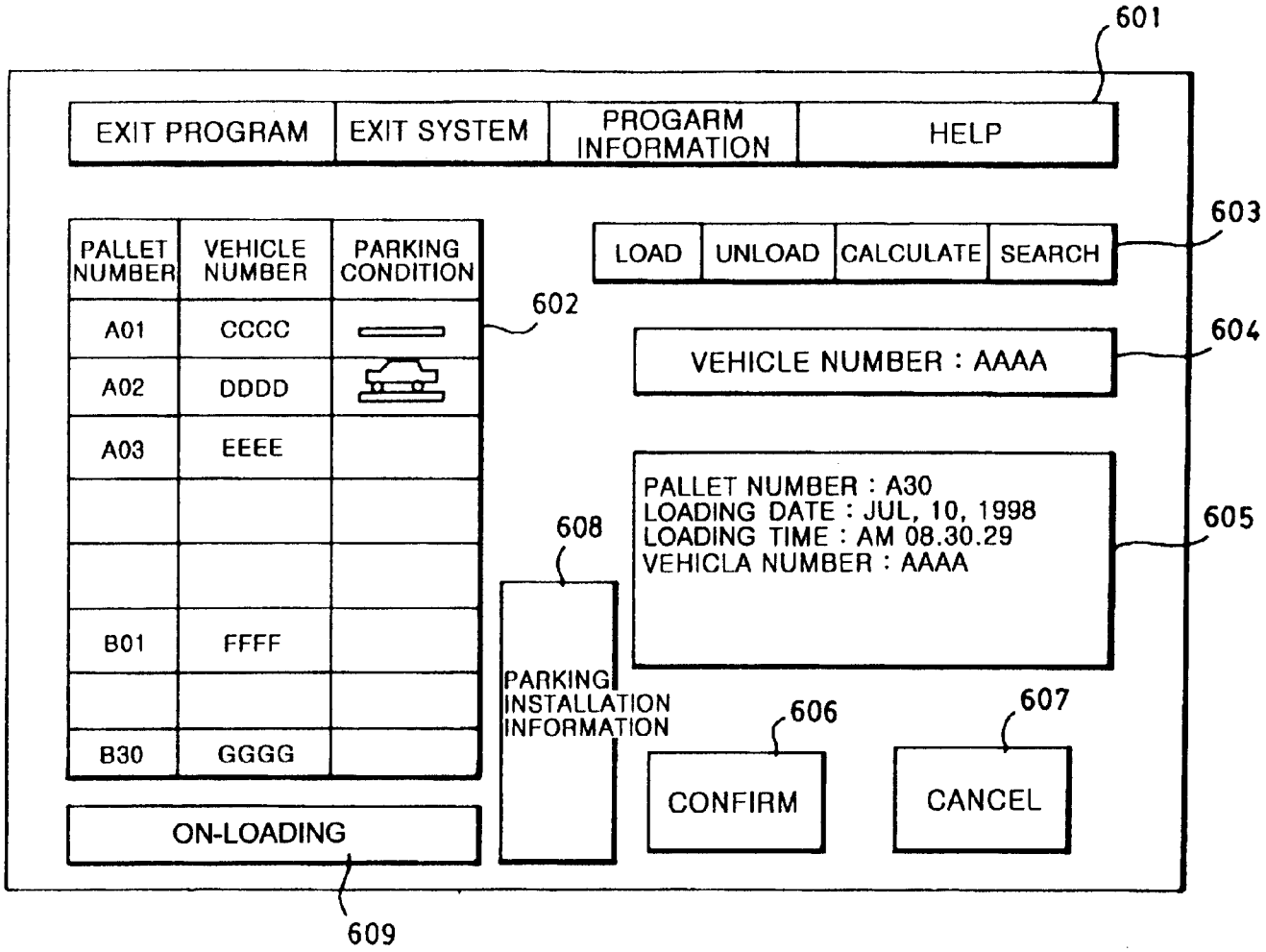

FIG. 11*a* shows an example of the loading screen, and FIG. 11*b* shows the example of the loading screen in detail. As shown in the figures as an example, the loading screen has a screen construction divided in a program menu region 601, a parking installation displaying region 602, a function selecting region 603, a vehicle number inputting region 604, a loading information region 605, a confirmation button region 606, a canceling button region 607, a parking installation information region 608, and a parking installation status region 609, for processing mouse events generated on the screen in time of loading.

Figure 11C:
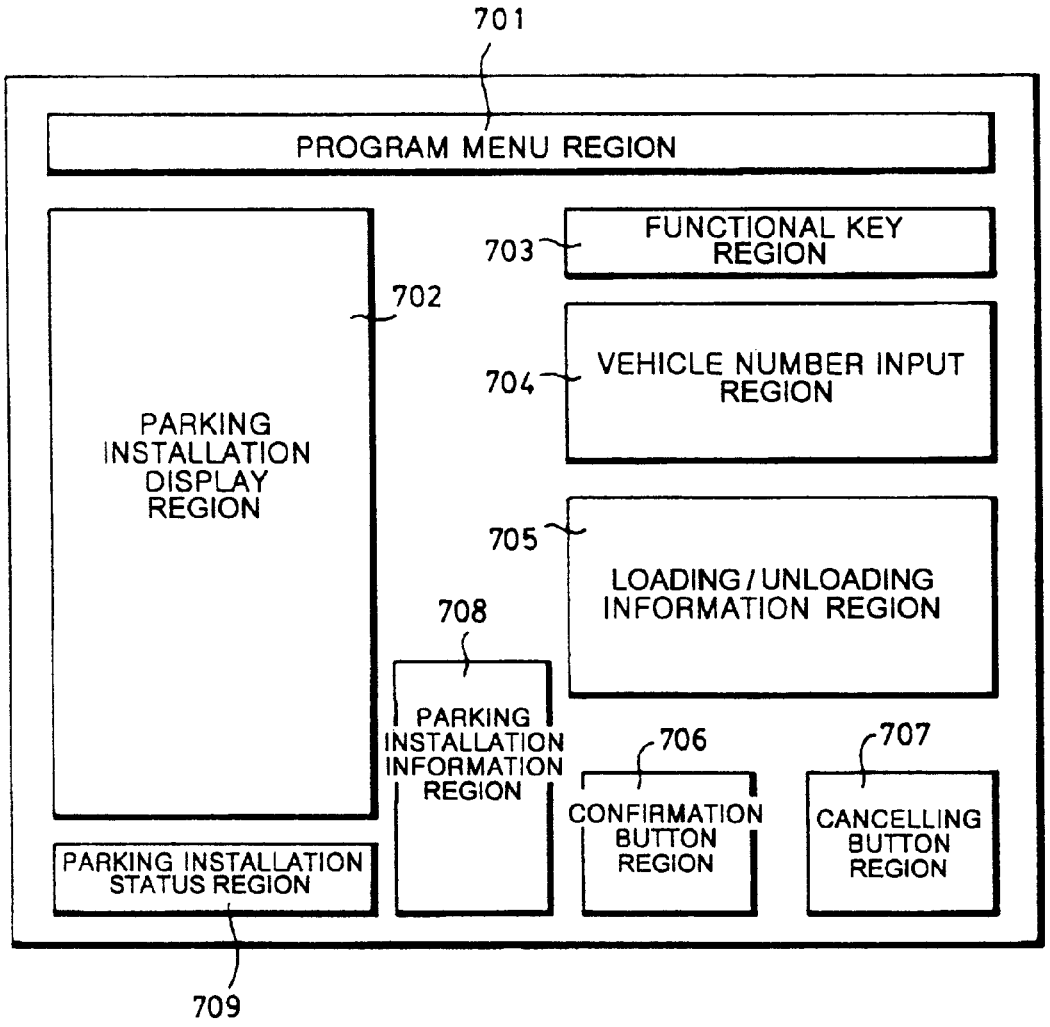

FIG. 11*c* shows an example of the unloading screen. As shown in the figure as an example, the unloading screen has a screen construction divided in a program menu region 701, a parking installation displaying region 702, a function selecting region 703, a vehicle number and fee displaying region 704, a loading/unloading information region 705, a confirmation button region 706, a canceling button region 707, a parking installation information region 708, and a parking installation status region 709, for processing mouse events generated on the screen in time of unloading.

Figure 11D:
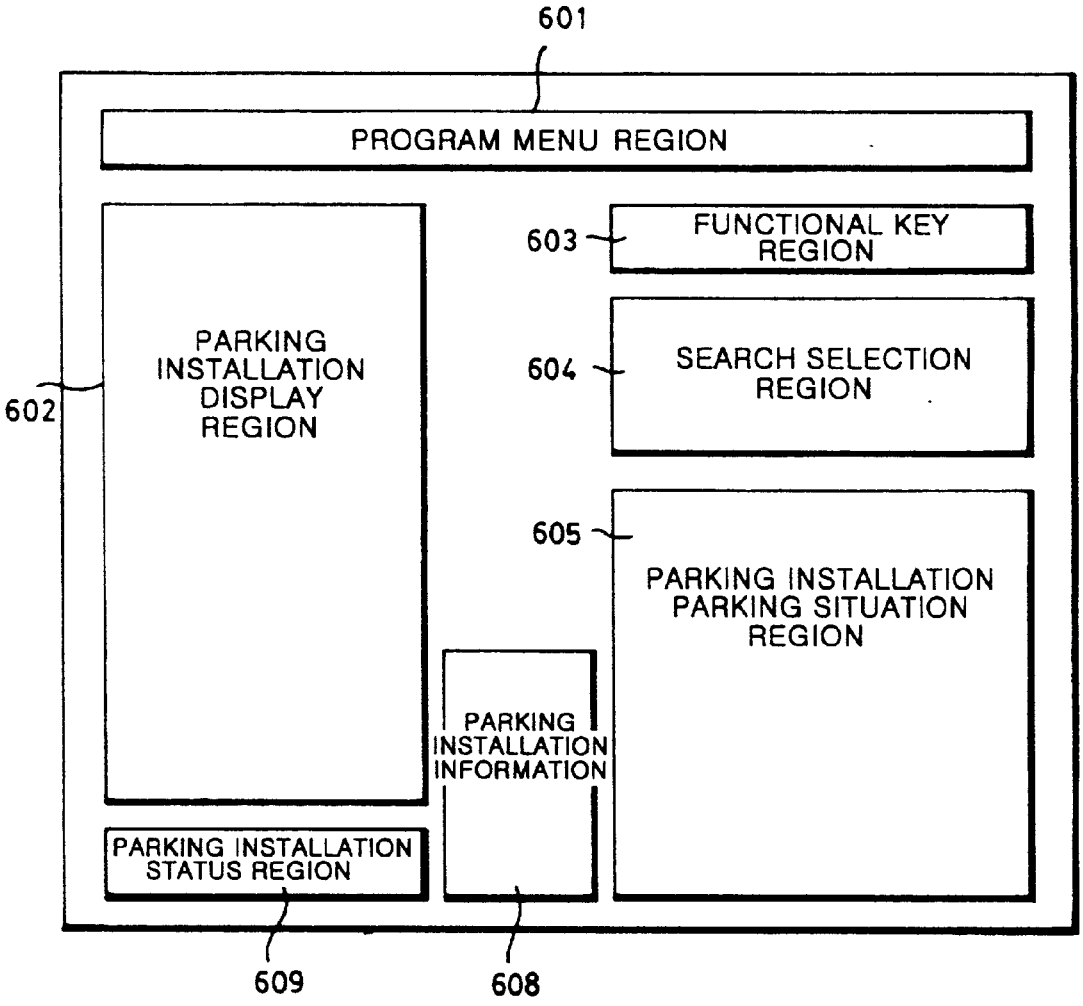

FIG. 11*d* shows an example of the search screen. As shown in the figure as an example, the search screen has a screen construction divided in a program menu region 801, a parking installation displaying region 802, a function selecting region 803, a search selection region 804, a parking installation parking situation region 805, a parking installation information region 806, and a parking installation status region 807, for processing mouse events generated on the screen in time of unloading.

Figure 11E:
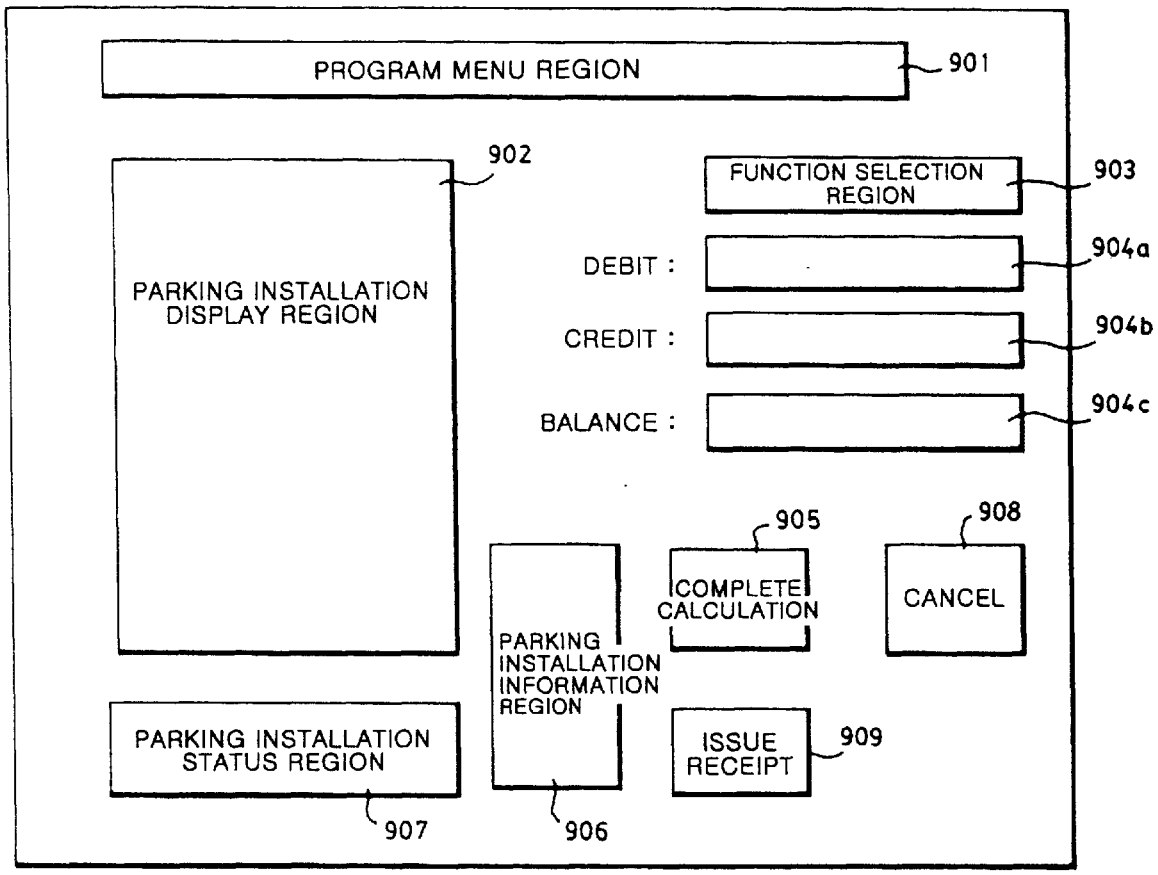

FIG. 11*e* shows an example of the calculation screen. As shown in the figure as an example, the calculation screen has a screen construction divided in a program menu region 901, a parking installation displaying region 902, a function selecting region 903, a debit displaying region 904*a*, a credit displaying region 904*b*, a balance displaying region 904*c*, a calculation completing region 905, a parking installation information region 906, a parking installation status region 907, a canceling region 908, and a receipt issuing region 909.

FIG. 12 shows an example of the parking ticket. In the figure, a serial number recorded in bar code, a parking date and time, a pallet number, a loaded position, and a vehicle number can be recorded on the parking ticket.

Hereinafter, operations of the components described above according to the present invention will be explained in more detail, referring to the FIGS. 5 to 12.

If power is supplied to each process in FIG. 5, the program in FIG. 6 is executed, and then the initial screen is displayed on the screen of the monitor 504 for informing the start of the program S100.

Then, the initializing process according to flows in FIG. 7 for opening the database, initializing the system value, comparing the car to be loaded in the parking installation, and beginning combination is implemented in the program initializing process S200.

That is, as shown in FIG. 7, the form position is set by reading data, read from the data base, about the arrangement and the configures of the screens S211. Then, the values of each region of the screens are read and updated from the database S212. After that, the optional data such as the kind of the parking installation, the basic fee, the additional fee per 10 minute, the name of the parking lot, the greetings, the forms of the parking ticket and the receipt, the font style, and so on by the user S213 and the types of the communication network connecting to the parking controller S214. And the identifier of each pallet in the parking installation, the car presence data corresponding to each identifier, and the vehicle number, which are read from the database, are displayed on the parking installation displaying region of the screen S215. Then, the identifier of each pallet in the parking installation, the car presence data corresponding to each identifier are read from the controller S216, and compared with the data from the database S217. If there is difference in result of the comparison, the data are corrected by giving priority to credibility of the data of the controller and displayed on the displaying region of the screen S218, the parking installation status information is requested to be transmitted from the controller S219, and the parking installation status information is displayed on the parking installation status region of the screen S220.

The process for the loading operation will be explained referring to the FIGS. 5, 9*a*, 10*a*, 11*a*, and 11*b*.

If a driver alights from a car after driving the car on the lift, the car detecting signals, which are sensed from sensors, such as photo sensors or weight sensors, mounted on the lift for sensing the presence of the car on the lift, are transmitted to the controller 107A which is connected to the sensors via transmission line, and then the signals are transmitted to the data processor 501*b*.

Therefore, the data processor 501*b* outputs the loading information signal to the display, for example the monitor 504, for displaying the loading screen such as FIG. 11*a* according to the predetermined program. Then a manager in a management office identifies the vehicle number of the car loaded on the lift, and inputs the vehicle number on the vehicle number inputting region 604 of the loading screen of the FIG. 11*a* with use of the keyboard 507. The management office is installed near the lift so that the manager need not move to the car for identifying the vehicle number. After inputting the vehicle number, the manager clicks the mouse 509 or pushes the enter key on the keyboard 507, on the confirmation button region 606 of FIG. 11*a*. Then the data processor 501*b* detects the confirmation, then transmits a signal instructing the loading operation to the loading/unloading control processor, and at the same time, automatically creates data such as the serial number, the loading date and time, the kind of the customer, and the like together with the vehicle number and stores them on the respective data field, and at the same time again, transmits those data and other data predetermined on the database to the parking ticket issuer 502 so to issue the parking ticket.

In particular, the serial number among the predetermined data described above is updated every time of the loading the cars, and the loading date and time is automatically generated by a timer equipped in the data processor 501*b*. And the kind of the customer has an information representing a special customer or a general customer. For example, the special customer is a customer who has prepaid a parking fee for one month. In case of the special customer, the data informing the special customer is displayed on the display 504, and can be automatically generated by reading the vehicle number, stored in the database 501*d*, from corresponding data field having the kind of the customer when inputting the vehicle number. Of course, the manager must input the kind of the customer at first time. Such information about the kind of the customer should be considered in calculating the parking fee. In case of the special customer, an operation of the calculating processor 501*c*, a displaying operation of the debit/credit display 505, or a receipt issuing operation is not needed to be performed separately until expiration of a prepaid term. Therefore, the data processor 501*b* reads the type of the customer information from the database 501*d*, then, in case of the special customer, stops outputting signal of the calculating processor 501*c*, and displays information showing the special customer on the loading/unloading information region 705 of FIG. 11*b*. The predetermined data, stored in the database 501*d*, are the kind of the parking installation data, the basic fee data, the additional fee per 10 minutes data, the name of the parking lot data, the greetings data, the parking ticket form data, the font style data, a manager ID data, and the like, for example, as shown in the step 213 of FIG. 7. The data are input in the initial setting step of the system, and stored in a respective data field of the database 501*d* by the data processor 501*b*. The manager ID is numbers or characters for confirming the manager who works in respective data and time of the loading. The base fee is requested on every parking of the general customer, and a final fee, which is made by adding the additional fee per a parking period, for example 10 minutes, to the basic fee, is requested in unloading the car. The name of parking lot data are a store name of the parking lot. The greetings data are greetings such as "Thank you" for being printed on the receipt or the parking ticket. The parking ticket form data are selectable data of printed positions of the data or size of characters and numbers to be printed. The font style data is selectable data of the characters on the receipt or the parking ticket.

In addition to the data, the database 501*d* also stores data about a number of empty pallets, a number of occupied pallets, the identifier of the every pallet in the parking installation, and a symbol or graphic for displaying the parking situation of the car, all of which are input from the control unit 107A, and the parking installation status data, namely malfunction status data, an automatic standby status data, the loading status data, an on-unloading status data, and the like which are read from the control unit 107A through the loading/unloading control processor 501*a*.

In starting or restarting the parking control system of the present invention, the data processor 501*b* reads the predetermined data from the database 501*d* as expressed as the step 213 in FIG. 7, and displays the data on the display 504 as shown in FIG. 8.

The parking ticket issuer 502 is in a shape of storing the parking ticket in a continuous roll. The parking ticket issuer can be in a shape of cutting and pushing out the parking ticket in a sheet, and can be in a shape of just pushing out the parking ticket which already has dotted line to be cut. And the parking ticket issuer 502 prints information such as the basic fee, the additional fee per 10 minutes, the parking ticket issuing date, the loading time, the loading position or the identifier of the loading pallet, the vehicle number, the serial number, and the like, which are received from the data processor 501*b*, together with the preprinted information. Additionally, in the parking ticket issuer 502, the serial number of the loading can be printed on the bar code or with the character and number data for processing the information rapidly.

The parking ticket has, for example, a form shown in FIG. 13. The contents of "Parking Ticket", "the kind of the parking installation", "Thank you", "the name of the parking lot", and the like can be included on the parking ticket as printed, and can be printed after receiving the data, stored in the database 501*d* already, from the data processor 501*b*.

If the parking ticket issuer 502 issues the parking ticket, the manager sends the parking ticket to the customer or the driver, or otherwise, the driver can receive the ticket directly. Then in unloading out the car, the driver is announced to return the parking ticket to the manager, or otherwise, the driver can put the ticket in the parking ticket recognizer directly.

If the pallet information data, stored in the database, are received together with the loading command signal from the data processor 501*b* as described above, the loading/unloading control processor 501*a* generates the identifier data of a determined pallet among the empty pallets together with the loading operating command signal and outputs the signals according to the predetermined program.

In this point, the program logic for determining a loading pallet among the empty pallets is explained as followed. If the loading and the unloading are simultaneously requested, the lift, which have finished loading, is not returned to the lobby floor in empty status and then is not lifted again for unloading, but the lift needs to unload the car, which is in equal to or lower floor than the loading floor and then return to the lobby floor. So, under such situations, a pallet equal positioned as or higher positioned than the pallet to be unloaded is determined as a loading pallet for saving an electric power consumption. And if only the loading operation is required, a logic that an empty pallet nearest to the lobby floor is selected is applied.

The loading pallet information data determined as above is stored in the respective data field of the database 501*d* and, at the same time, transmitted to the display 504 and displayed on the loading pallet information region of the loading information region 605 of FIG. 11*a*.

On the other hand, after receiving the loading command signal and the identifier data of the pallet used for loading, the control unit 107A transmits the position control signal, stored in accordance with the identifier of the pallet used for loading, to the motor drive, which controls the motor, for driving the motor, which drives the lift as shown in the flow chart of FIG. 10*a* S412. By operating the lift driving motor with use of the position control signal, the lift lifts to a position higher than the pallet used for loading in a predetermined height, then unload the car to the pallet approached to lower portion of the lift, and then returns to its initial position. The loading operation is completed by such a process above. In the above process, the driving of the pallet can be achieved by a separate driving motor, not shown in the figures, and a driving control signal of the driving motor is generated on the basis of a predetermined forward-rotation driving value and a reverse-rotation driving value, which are already stored in the control unit 107A.

If both of an output signal from the vehicle presence sensor mounted on the lift and an output signal from the vehicle presence sensor mounted on the pallet are transmitted through the control unit 107A, "YES" divergence in the S414, the control unit determines that the loading process is completed S415. Then the control 107A generates a signal of reporting the completion of the loading and transmits the signal to the data processor 501*b*, S416.

The program memory stores information such that the lift, completing the loading operation, automatically returns to the lobby floor, or the floor in which the driver loaded the car on the lift S422, and stands by the next loading or unloading S423, if the unloading command signal and the identifier of the pallet for unloading are not transmitted from the loading/unloading control processor 501*a*, "NO" divergence of S417. At this time, if the lift returns to the lobby floor, the lift presence sensor, for example photo sensor composed of a light emitting portion and a light receiving portion, senses that status. Then the output signal, informing that the parking installation is now in an automatic standby status, is transmitted to the control unit 107A. The control unit 107A transmits the standby status signal to the data processor 501*b* in the management office. The data processor 501*b* stores such status information on the respective data field of the database 501*d*, and at the same time, transmits the information to the display 504 so to display that information on the parking installation status region 609 in FIG. 11*a*.

The information, displayed on the parking installation status region 609 in FIG. 11*a*, includes the parking installation malfunction information, the loading standby status information described above, the parking installation on-loading information, and the parking installation on-unloading information.

Numerous sensors can be used for detecting the parking installation malfunction information, which are mounted in the parking installation. Namely, sensors for sensing the car presence on the lift or the pallet, sensors for sensing whether doors of the car are open or closed after the driver loads the car on the lift for loading, and sensors for detecting signals which are output from the encoders mounted on a rotating axis of the motor for controlling the pallet position are connected to the control unit 107A. Therefore, if the control unit 107A does not receive the output pulse signal from the encoder in a predetermined period after outputting the motor driving signal and the loading position command signal, the control unit 107A determines that the parking installation is in failure, and transmits the failed status information signal, informing the above state, to the data processor 501*b*.

On the other hand, until the data processor 501*b* receives the data informing the completion of the loading from the control unit after the loading command signal is output from the loading/unloading control processor 501*a*, the data processor determines that the parking installation is in the on-loading status, and displays the status information on the parking installation status region 609 in the display 504 of FIG. 11*a*, at the same time stores the information on the respective data field in the database 501*d*.

In case that the loading/unloading control processor 501*a* instructs the loading and the unloading simultaneously, if receiving a signal reporting the completion of the loading operation of the lift from the control unit 107A S416, the data processor determines that the parking installation is converted in the unloading status, and displays the status information on the parking installation status region 609 in the display 504 of FIG. 11*a*, at the same time stores the information on the respective field in the database 501*d*.

If the car presence sensing signal is transmitted from the car presence sensor mounted on the lift after the unloading command signal is output from the loading/unloading control processor 501*a*, S417, and if the lift is sensed to be returned to the lobby floor, "YES" divergence in S419, the data processor determines that the parking installation is in the on-unloading status, and then displays the status information on the parking installation status region 609 in the display 504 of FIG. 11*a*, at the same time stores the information on the respective data field in the database 501*d*.

The process of the unloading operation will be explained referring to FIGS. 5, 9*b*, 10*b*, 11*c*, and 11*e*.

In FIGS. 11*a* and 11*c*, the function selecting region 603, 703 are selection displaying regions ensuring the manager to select one function among four functions of loading, unloading, searching the loaded position, and calculating the fee.

If the customer wants to unload the car, the manager takes the parking ticket from the customer. The manager inserts the parking ticket in the parking ticket recognizer 503, and selects the unloading on the function selecting region 603 of the screen by clicking the mouse. Then the parking ticket recognizer 503 reads the serial number by converting the bar code into electric signals with use of a bar code scanner. While the bar code scanner is used in case that the bar code is printed on the parking ticket, instead of that, any scanner which converts character data and number data into the electric data can also be used. After that, the unloading screen is displayed on the display 504. After reading the bar code serial number, the serial number information is transmitted to the data processor 501*b* via the transmission line connecting the data processor 501*b* and the parking ticket recognizer 503. The data processor 501*b* reads all information, such as the vehicle number of the respective car, the loading date and time data, the kind of customer data, and the like, stored in the database together with the serial number, and reads the current time data from the timer mounted therein.

Then, the data processor transmits the data to the display 504, and specially transmits the current date and time data, the loading date and time data, the basic fee data, the additional fee per 10 minutes data, and the vehicle number data among the data to the calculating processor 501*c*.

Then, the calculating processor 501*c* calculates a parking period and a parking fee on the basis of the loading information data, and transmits the parking period data and the parking fee data together with the vehicle number data and the current time data to the display 504.

The display 504 displays the parking fee data and the vehicle number data among the data, such as the current time data, the parking period data, the parking fee data, and the kind of customer data, received from the calculating processor 501*c*, on the vehicle information and fee displaying region 704 of the unloading screen. And the display 504 displays the unloading information, such as the identifier of the pallet used for the unloading or the identifier of the pallet used for the loading, the unloading time or the current time, the parking period, and the like, on the loading/unloading information region 705 in the loading screen.

On the other hand, the loading/unloading information region 705, on which the unloading information and the loading information are displayed together, can display the loading information and the unloading information in case that there is any request for operating the loading and the unloading simultaneously.

The calculating processor 501*c* transmits the calculated parking fee data to the debit/credit display 505 for displaying the data on the upper row of the display. Therefore, if the manager clicks the mouse 509 on the calculation region in the function selecting region 703 in the unloading screen of FIG. 11*c* after the customer pays the fee, the calculating processor 501*c* reads the calculation displaying data from the database 501*d* for displaying the calculation screen of FIG. 11*e* on the display 504.

At this time, the parking fee data are displayed on the debit displaying region among the debit, credit, and balance displaying regions of the debit/credit display 505, and the other two displaying regions are empty. After that, if the manager inputs an amount of paid money with use of the keyboard, the calculating processor 501*c* transmits the respective amount data to the debit/credit display 505 for displaying the respective amount on the credit displaying region. Then the calculating processor transmits the balance data between the paid amount and the parking fee to the display 504 for displaying the balance on the balance displaying region 909*c* in the calculation screen in FIG. 11*e,* and at the same time transmits the balance data to the debit/credit display 505 for displaying the balance on the lower row.

If the manager clicks the mouse on the receipt issuing region 909 in the calculation screen after paying the balance to the customer, the calculating processor 501*c* creates the issuance command signal, and then transmits the current date and time data, the loading date and time data, the base fee data, the additional fee per 10 minutes data, the vehicle number data, and the debit/credit/balance data together with the issuance instructing signal to the receipt issuer 506 for issuing the receipt.

At this time, the calculating processor 501*c* reads the parking lot name data and the greetings data from the database 501*d* such that the receipt issuer prints the data on the receipt.

If the manager clicks the mouse 509 on the calculation completion region in the calculation screen of FIG. 11*e* after sending the receipt to the customer, the calculating processor 501*c* outputs the initialization instructing signal for initializing the display 504 and the debit/credit display 505 so to clear the debit/credit/balance data. The calculating processor then outputs an instructing signal of converting the screen of the display 504 to the unloading screen in FIG. 11*d.*

In the unloading screen, if the manager clicks the mouse on the confirmation button region 706 or pushes the enter key, the data processor 501*b* generates the unloading command signal. Then the data processor transmits the identifier of the loaded pallet corresponding to the vehicle number of the car to be unloaded, which is stored in the database 501, together with the unloading command signal to the loading/unloading control processor 501*a*. Following that, the loading/unloading control processor 501*b* generates the unloading command signal, and transmits the identifier of the loaded pallet together with the command signal to the control unit.

Therefore, for operating the motor which drives the lift and the pallet, the control unit 107A, which receives the unloading command signal and the identifier of the loaded pallet from the loading/unloading control processor 501*b,* transmits the position control signal, stored in accordance with the identifier of the loaded pallet, to the motor drive which controls the motor. The lift is approached to the pallet for unloading by operating the driving motor according to the position control signal. And the unloading operation is completed after unloading the car from the pallet to the lift and returning the lift to the lobby floor.

If the car presence sensing signal from the car presence sensor mounted on the lift and the lift sensing signal from the lift presence sensor mounted on the lobby floor are input to the control unit, "YES" divergence in S514, the control unit 107A determines that the unloading operation is completed, and reports the unloading completion signal to the data processor 501*b*. After that, the data processor 501*b* determines that the parking installation is in the automatic standby status, and displays the result on the display 504.

On the other hand, if not acknowledges the loading position owing to any reason like that the customer has lost the parking ticket, the manager can help the customer searching the car. The manager clicks the mouse 505 on the search region in the function selecting region on the screen. The data processor 501*b* reads the search screen information from the database 501*d* for displaying that on the display 504. Then the manager inputs the vehicle number, realized by the customer, on the vehicle number input region 804 with use of the keyboard 507. The data processor 501*b* reads the loading information data, such as the parking position, the serial number, the vehicle number, the loading data, the loading time, the kind of customer, the manager ID, the basic fee, the additional fee per 10 min., and the like, which are stored in each data field in accordance with the vehicle number from the database 501*d,* then displays the data through the display 504. Therefore, though losing the parking ticket, the loading and unloading operations are enabled.

The parking installation according to the present invention has advantages of securing the accuracy for calculating the parking fee, and effectively provides convenience to use it, by connecting the computer, the control unit, the parking ticket issuer, the parking ticket recognizer, and the like in a net work, and, as a result, by implementing the processes of operating the installation, issuing the parking ticket, recognizing the parking ticket, and calculating the fee together.

What is claimed is:

1. Automatic parking system comprising a parking apparatus having pallets used for loading a plurality of cars, a first motor for moving the pallets laterally, a first motor drive for providing a driving signal to the motor, a first sensor for sensing the presence of the car on the pallets, a first encoding means for detecting a position of the pallets by calculating a number of revolutions of the motor, at least one lift which is able to move vertically for loading the car on the pallets and unloading the car out of the pallets, a second sensor for sensing the presence of the car on the lift, a third sensor for sensing the presence of the lift on a respective floor, a second motor for moving the lift vertically, a second motor drive for driving the second motor, a second encoding means for detecting a position of the lift by calculating a number of revolutions of the second motor; and a parking controller connected to the first and second motor drives for outputting position control signals to each of them, for receiving feedbacks of a pallet position detect signal and a lift position detect signal from the first and second encoding means, for determining a present operating status of the parking apparatus on the basis of the position control signal, the position detect signal, and a sensing signal from the first and second sensors, for storing an identifier of each pallet and a vehicle number of a car loaded on the respective pallet, for receiving information of the presence or absence of a car on each pallet from the first sensor, and for storing the information, further comprising;

a keyboard;

a mouse for supporting a user to select a specific region on a screen by clicking thereon;

database means for storing each vehicle number which is input with use of the keyboard by user, current date and time data which are received on loading the car, data which have the pallet identifier, and information data about whether the car is parked on the respective pallet, data about a parking fee, data about a configuration of a loading screen, data about a configuration of an unloading screen, and data about a configuration of a calculation screen, in corresponding data fields;

means for displaying information data on the screen;

data processing means connected to the displaying means for selectively outputting loading data, unloading data, and calculation data, which are received from the database means, outputting a parking apparatus status signal, a signal of sensing the presence of the car on each pallet received from the parking controller to be displayed on a corresponding region of the loading screen or the unloading screen displayed by the displaying means, for receiving a signal of sensing the presence of the car on the lift from the controller when the car is loaded on the lift, for creating loading time data containing current date and time data by a timer equipped therein when the user inputs the vehicle number with use of the keyboard, for creating loading serial number data updated for each time of loading, then outputting the loading serial number data to the database means together with the vehicle number data, and for creating and outputting a loading/unloading command signal;

processing means for controlling car loading/unloading, for receiving a command loading/unloading signal and a vehicle number data signal of the car to be loaded or unloaded from the data processing means, in case of loading for receiving the loading command signal and the vehicle number data signal from the data processing means, determining a pallet having priority among the empty pallets depending on the presence data of the car on the pallets stored in the database means, for outputting an identifier signal of the pallet determined by the controller, and at the same time, outputting the identifier signal of the pallet determined and the vehicle number data signal on the displaying means for displaying on the loading screen, in case of unloading for receiving the unloading command signal and the vehicle number data signal from the data processing means and outputting the vehicle number data signal together with the unloading command signal to the controller;

means for processing calculation for receiving current date and time data, the loading time data, and the fee data from the data processing means, calculating a parking fee to be requested to a customer on the basis of an elapsed time from the loading time and the fee data, then creating and outputting a debit data signal according to the result of the calculation, for receiving a fee payment data of the customer from the data processing means, creating and outputting a credit data signal, for calculating difference between the credit data signal and the debit data signal, and then creating and outputting the result as a balance data signal;

a parking ticket issuer for issuing the parking ticket on the basis of the loading serial number data, the loading date and time data, the vehicle number data, and the identifier data of the pallet used for loading, received from the data processing means; and a parking ticket recognizer for scanning the parking ticket and outputting the loading serial number data to the data processing means.

2. The automatic parking system as claimed in claim 1, further comprising a debit/credit displaying means for receiving the debit data signal, the credit data signal, and the balance data signal from the calculation processing means, and then displaying the signals to the customer.

3. The automatic parking system as claimed in claim 1, wherein a debit/credit displaying means is a Liquid Crystal Display of three rows, each displaying the debit data, the credit data, and the balance data.

4. The automatic parking system as claimed in claim 1, further comprising a receipt issuer for receiving the debit data signal, the credit data signal, and the balance data signal from the calculation processing means, and then printing the data on a receipt.

5. Automatic parking system comprising a parking apparatus having pallets used for loading a plurality of cars, a first motor for moving the pallets laterally, a first motor drive for providing a driving signal to the motor, a first sensor for sensing the presence of the car on the pallets, a first encoding means for detecting a position of the pallets by calculating a number of revolutions of the motor, at least one lift which is able to move vertically for loading the car on the pallets and unloading the car out of the pallets, a second sensor for sensing the presence of the car on the lift, a third sensor for sensing the presence of the lift on a respective floor, a second motor for moving the lift vertically, a second motor drive for driving the second motor, a second encoding means for detecting a position of the lift by calculating a number of revolutions of the second motor;

a parking controller connected to the first and second motor drives for outputting position control signals to each of them, for receiving feedbacks of a pallet position detect signal and a lift position detect signal from the first and second encoding means, for determining present operation status of the parking apparatus on the basis of the position control signal, the position detect signal, and a sensing signal from the first and second sensors, for storing an identifier of each pallet and a vehicle number of a car loaded on the respective pallet, for receiving information of the presence or absence of a car on each pallet from the first sensor and for storing the information; and a manipulating unit having a button unit having a plurality of number and character keys and a plurality of function keys, for selectively inputting the vehicle number and the pallet identifier or canceling the input information, inputting information to perform function of searching a loading position or of unloading a car out of a parking place, and inputting information for resetting the function, by pushing the buttons;

a first displaying means for displaying the presence of the car on each pallet;

a second displaying means for selectively displaying the vehicle number information which is input by the input button unit, the identifier information of the pallet on which the car is loaded, and a present operation status information of the parking apparatus; and a microprocessor for processing and storing the data input by the input button unit according to a predetermined program, and at the same time, outputting the data to the first and second displaying means so to be displayed, for transmitting the vehicle number information or the pallet identifier information to the controller, for outputting the car presence data on the pallet and the current operating status data of the parking apparatus to the first and second displaying means respectively so to be displayed thereon, the automatic parking system further comprising;

a keyboard;

a mouse for supporting a user to select a specific region on a screen by clicking thereon;

database means for storing each vehicle number which is input with use of the keyboard by user, current date and time data which are received on loading the car, data which have the pallet identifier and information data about whether the car is parked on the respective pallet, data about a parking fee, data about a configuration of a loading screen, data about a configuration of a unloading screen, and data about a configuration of a calculation screen, in respective data fields;

means for displaying information data on the screen;

data processing means connected to the displaying means for selectively outputting loading data, unloading data, and calculation data received from the database means to the displaying means, outputting a parking apparatus status signal, a signal of sensing the presence of the car on each pallet received from the parking controller to be displayed on a corresponding region of the loading screen or the unloading screen displayed by the displaying means, for receiving a signal of sensing the presence of the car on the lift from the controller when the car is loaded on the lift, for creating loading time data containing current date and time data by a timer equipped therein when the user inputs the vehicle number with use of the keyboard, for creating loading serial number data updated for each time of loading, then outputting the loading serial number data on the database means together with the vehicle number data, and for creating and outputting a loading/unloading command signal;

processing means for controlling car loading/unloading, for receiving a loading/unloading command signal and a vehicle number data signal of the car to be loading/unloading from the data processing means, in case of loading for receiving the loading command signal and the vehicle number data signal from the data processing means, determining a pallet having priority among the empty pallets depending on the presence data of the car on the pallets stored in the database means, for outputting a identifier signal of the pallet determined by the controller, and at the same time, outputting the identifier signal of the pallet determined and the vehicle number data on the displaying means for displaying on the loading screen, in case of unloading for receiving the unloading command signal and the vehicle number data signal from the data processing means and outputting the vehicle number data signal together with the unloading command signal to the controller;

means for processing calculation for receiving current date and time data, the loading time data, and the fee data from the data processing means, calculating a parking fee to be requested to a customer on the basis of an elapsed time from the loading time and the fee data, then creating and outputting a debit data signal according to the result of the calculation, for receiving a fee payment data of the customer from the data processing means, creating and outputting a credit data signal, for calculating difference between the credit data and the debit data, and then creating and outputting the result as a balance data signal;

a parking ticket issuer for issuing a parking ticket on the basis of the loading serial number data, the loading date and time data, the vehicle number data, and the identifier data of the pallet used for loading, received from the data processing means; and a parking ticket recognizer for scanning the parking ticket and outputting the loading serial number data to the data processing means.

6. The automatic parking system as claimed in claim 5, further comprising a debit/credit displaying means for receiving the debit data signal, the credit data signal, and the balance data signal from the calculation processing means, and then displaying the signals to a customer.

7. The automatic parking system as claimed in claim 5, wherein a debit/credit displaying means is a liquid crystal display of three rows, each displaying the debit data, the credit data, and the balance data.

8. The automatic parking system as claimed in claim 5, further comprising a receipt issuer for receiving the debit data signal, the credit data signal, and the balance data signal from the calculation processing means, and then printing the data on a receipt.

9. Automatic parking system comprising a parking apparatus having a plurality of loading/unloading means for loading/unloading cars, a driving means for driving the loading/unloading means, and a control means for controlling the driving means;

a keyboard;

a mouse for supporting a user to select a specific region on a screen by clicking thereon;

database means for storing each vehicle number which is input with use of the keyboard by user, current date and time data which are received on loading the car, data which have the pallet identifier and information about whether the car is parked on the respective pallet, data about a parking fee, data about a configuration of a loading screen, data about a configuration of a unloading screen, and data about a configuration of a calculation screen, in corresponding data fields;

means for displaying information data on the screen;

means for processing data connected to the displaying means for selectively outputting loading data, unloading data, and calculation data, which are received from the database means, outputting a parking apparatus status signal, a signal of sensing the presence of the car on each pallet received from the parking controller to be displayed on a corresponding region of the loading screen or the unloading screen displayed by the displaying means, for receiving a signal of sensing the presence of the car on the lift from the controller when the car is loaded on the lift, for creating loading time data containing current date and time data by a timer equipped therein when the user inputs the vehicle number with use of the keyboard, for creating loading serial number data updated for each time of loading, then outputting the loading serial number data to the database means together with the vehicle number data, and for creating and outputting a loading/unloading command signal;

processing means for controlling car loading/unloading, for receiving a command loading/unloading signal and a vehicle number data signal of the car to be loaded or unloaded from the data processing means, in case of loading for receiving the loading command signal and the vehicle number data signal from the data processing means, determining a pallet having priority among the empty pallets depending on the presence data of the car on the pallets stored in the database means, for outputting a identifier signal of the pallet determined by the controller, and at the same time, outputting the identifier signal of the pallet determined and the vehicle number data to the displaying means for displaying on the loading screen, in case of unloading for receiving the unloading command signal and the vehicle number data signal from the data processing means, outputting the vehicle number data signal together with the unloading command signal to the controller;

means for processing calculation for receiving current date and time data, the loading time data, and the fee data from the data processing means, calculating a parking fee to be requested to a customer on the basis of an elapsed time from the loading time and the fee data, then creating and outputting a debit data signal according to the result of the calculation, for receiving a fee payment data of the customer from the data processing means, creating and outputting a credit data signal, for calculating difference between the credit data signal and the debit data signal, and then creating and outputting the result as a balance data signal.

* * * * *